US005508139A

United States Patent [19]

Tanaka et al.

[11] Patent Number: 5,508,139

[45] Date of Patent: Apr. 16, 1996

[54] MAGNETIC TONER FOR DEVELOPING ELECTROSTATIC IMAGE

[75] Inventors: Katsuhiko Tanaka, Machida; Takayuki Nagatsuka, Yokohama; Rika Doi, Kawasaki, all of Japan

[73] Assignee: Canon Kabushiki Kaisha, Tokyo, Japan

[21] Appl. No.: 215,624

[22] Filed: Mar. 22, 1994

[30] Foreign Application Priority Data

Mar. 25, 1993 [JP] Japan ..... 5-089475

[51] Int. Cl.[6] ..... G03G 9/09; G03G 9/083

[52] U.S. Cl. ..... 430/106; 430/106.6; 430/110; 430/111

[58] Field of Search ..... 430/106, 106.6, 430/110, 111

[56] References Cited

U.S. PATENT DOCUMENTS

| | | | |
|---|---|---|---|
| 2,297,691 | 10/1942 | Carlson | 430/31 |
| 4,623,606 | 11/1986 | Ciccarelli | 430/110 |
| 5,439,770 | 8/1995 | Taya et al. | 430/106 |

FOREIGN PATENT DOCUMENTS

| | | |
|---|---|---|
| 0180655 | 5/1986 | European Pat. Off. . |
| 0314459 | 5/1989 | European Pat. Off. . |
| 0461672 | 12/1991 | European Pat. Off. . |
| 0468525 | 1/1992 | European Pat. Off. . |
| 42-23910 | 11/1967 | Japan . |
| 43-17955 | 7/1968 | Japan . |
| 43-24748 | 10/1968 | Japan . |
| 55-42752 | 11/1980 | Japan . |
| 58-95748 | 6/1983 | Japan . |
| 58-98744 | 6/1983 | Japan . |
| 61-101558 | 5/1986 | Japan . |
| 61-155463 | 7/1986 | Japan . |
| 61-155464 | 7/1986 | Japan . |
| 63-1994 | 2/1988 | Japan . |
| 63-267793 | 11/1988 | Japan . |
| 3-95578 | 4/1991 | Japan . |

OTHER PUBLICATIONS

Database WPI, Week 8634, Derwent, AN86–223210, based on JPA61–155464.

*Primary Examiner*—Roland Martin

*Attorney, Agent, or Firm*—Fitzpatrick, Cella, Harper & Scinto

[57] ABSTRACT

A magnetic toner for developing an electrostatic image is disclosed which has a binder resin, a magnetic material and an iron compound of the formula (I). The magnetic toner has a saturation magnetization of 20 to 50 $Am^2/kg$ and a coercive force of 40 to 200 oersted.

16 Claims, 2 Drawing Sheets

MAGNETIC TONER FOR DEVELOPING ELECTROSTATIC IMAGE

BACKGROUND OF THE INVENTION

1. Field of the Invention

This invention relates to a magnetic toner for developing an electrostatic image, used in image forming processes such as electrophotography and electrostatic recording, to render electrostatic latent images visible.

2. Related Background Art

As electrophotography, various methods are disclosed in U.S. Pat. No. 2,297,691, Japanese Patent Publication No. 42-23910 and Japanese Patent Publication No. 43-24748 and so forth.

Developing systems applied in such electrophotography are roughly grouped into a dry developing method and a wet developing method. The former is further grouped into a method making use of one-component developers and a method making use of two-component developers. The developing method making use of one-component developer has a feature that developing apparatus can be made small-sized. This method, however, has difficulty in imparting sufficient triboelectricity to the toner and hence it has the problem that the allowable scope for designing toners and developing systems is narrow. On the other hand, the developing method making use of the two-component developer can impart sufficient charges to toners and hence has the advantage that it has wider tolerance for designing, but has a problem that it requires a means for uniformly controlling the mixing ratio of the toner and the carrier, making its apparatus complicated.

As toners used in these developing methods, fine powders comprising a colorant such as a dye or pigment dispersed in a natural or synthetic resin are hitherto used. For example, toner particles are prepared by pulverizing a dispersion of a colorant in a binder resin such as polystyrene to a size of about 1 to 30 μm. As a magnetic toner, toner particles containing magnetic material particles such as magnetite are used.

Toners have positive charges or negative charges depending on the polarity of electrostatic latent images to be developed. In order to charge toners, it is possible to utilize triboelectric chargeability of resins that compose toners. In such a method, however, the chargeability of the toner is so small that toner images obtained by development tend to be foggy and unclear. In order to impart a desired triboelectric chargeability to toners, a dye or pigment capable of controlling chargeability and also a charge control agent are commonly added.

However, toners containing such charge control agents tend to contaminate the toner carrying members such as the developing sleeve, and hence such toners tend to cause a decrease in quantity of triboelectricity as the number of copies taken increases, resulting in a decrease in image density. Charge control agents of a certain type have a small quantity of triboelectricity and tend to be affected by temperature and humidity, and hence may cause variations of image density in accordance with environmental changes. Certain charge control agents have a poor dispersibility in resins, and hence toners making use of such charge control agents tend to have uneven triboelectricity between toner particles, tending to cause fogging. Certain charge control agents have poor storage stability so that toners may undergo a decrease in triboelectric performance during long-term storage.

As a means for solving these problems, Japanese Patent Publication Nos. 43-17955, 55-42752 and 63-1994 propose various kinds of metal complexes as charge control agents. These charge control agents certainly have a good negative triboelectric chargeability. Most of them, however, are chromium compounds, and more improvement has been sought from the viewpoint of environmental safety.

Japanese Patent Application Laid-open Nos. 61-155464, 61-101558 and 61-155463 propose iron complexes.

These publications disclose that the iron complexes have a negative triboelectric chargeability and have a very good compatibility with resins. However, studies made by the present inventors have revealed that only some of them can provide magnetic toners providing a more stable image quality in the one-component development system as described later.

In order to maintain the high image quality obtained at the initial stage, without regard to the number of copies taken, it is insufficient to only maintain the quantity of triboelectricity. The particle size distribution of the toner at the initial stage must also be kept constant. In particular, it is important for the toner particles of relatively large particle size (coarse powder) to be used in development in a good efficiency to prevent their accumulation. For such purpose, the magnetic properties and quantity of triboelectricity of magnetic toners must be adjusted to proper values. Taking these points into account, the present inventors have studied charge control agents to find but the quantity of negative triboelectricity becomes smaller when organic ammonium ions are used as counter ions. The reason is unclear, but it is presumed to be due to a positive triboelectric chargeability inherent in organic ammonium ions as generally known in the art. Japanese Patent Application Laid-open No. 61-101558 discloses that organic ammonium ions are effective to improve the dispersibility of metal complexes in resins. According to the studies made by the present inventors, however, in the case of one-component developers making use of magnetic toners, the organic ammonium ions exert greater influence on a decrease in triboelectric chargeability than on the improvement of dispersibility, so that the coarse powder in the toner accumulates as developing is repeated many times, to cause a slight lowering of image quality.

Polyvalent inorganic ions disclosed in Japanese Patent Application Laid-open No. 63-267793 also have caused accumulation of the coarse powder in toners. Negative charge control agents disclosed in Japanese Patent Application Laid-open No. 63-267793 have polyvalent ions as counter ions to make the molecular structure larger, so that they show more improved dispersibility in resins than the negative charge control agent disclosed in Japanese Patent Application Laid-open No. 61-155464. As a result, the carrier contamination due to the toner can be repressed prolonging the life time of the developer from 50,000 to 100,000 sheets copying to 200,000 sheet or more as so disclosed therein. According to the studies made by the present inventors, however, in order to maintain the good image quality at the initial stage using a magnetic toner in one-component development, it is necessary not only to keep the quantity of triboelectricity constant, but as previously stated, also to maintain a high quantity of triboelectricity, so that the coarse powder in the toner can also participate in the development. From such viewpoints, the iron complexes of polyvalent ions as disclosed in Japanese Patent Application Laid-open No. 63-267793 are not suited for magnetic toners. The coarse powder tends to accumulate also in the case of the iron complexes having a substituent such as a nitro group as shown in Japanese Patent Application Laid-open No. 61-155463, or those having a sulfonamide group, in Japanese Patent Application Laid-open No. 61-155464.

Meanwhile, with regard to magnetic properties of magnetic toners, proposals are made as follows:

Japanese Patent Application Laid-open Nos. 58-95748, 58-98744 and 3-95578 report the magnetic properties of magnetic toners.

According to Japanese Patent Application Laid-open No. 58-95748, saturation magnetization has an influence on transport performance of magnetic toner particles. Those with a saturation magnetization less than 23 emu/g weaken magnetic transport power to tend to cause uneven development. Those with a saturation magnetization more than 50 emu/g require a large quantity of magnetic powder in magnetic toners to make fixing performance low or developing performance poor. Toner particles with a coercive force less than 150 oersted greatly lower the developing performance, and those with a coercive force more than 350 oersted strengthen agglomeration force of toner particles to cause a problem in toner transport performance.

Japanese Patent Application Laid-open No. 58-98744 discloses that coercive force of 150 oersted or more is required in order to obtain fog-free images in reversal development.

Japanese Patent Application Laid-open No. 3-95578 discloses to reduce the quantity of a magnetic material so that a color toner with less turbidity can be obtained. For this reason, the magnetic toner is made to have a saturation magnetization of 40 emu/g or less, and a magnetic roller (a developing sleeve) is designed so as to compensate for any lowering of the transport power of the magnetic toner. In any case, the saturation magnetization is controlled taking into account the transport performance of magnetic toners and the coercive force is controlled for developing performance. Although the image quality at the initial stage can be improved by controlling magnetic properties of the magnetic toner, it is difficult to control image deterioration due to changes in toner particle size that may occur as developing is repeated many times. In order to prevent the magnetic toner from changing particle size, both the quantity of triboelectricity of the magnetic toner and the magnetic properties thereof must be taken into account.

SUMMARY OF THE INVENTION

An object of the present invention is to provide a magnetic toner for developing an electrostatic image, having solved the problems discussed above.

Another object of the present invention is to provide a toner for developing an electrostatic image, causing less image deterioration during the development of a large number of copying sheets.

Still another object of the present invention is to provide a magnetic toner having a superior environmental stability.

A further object of the present invention is to provide a magnetic toner having a superior stability when left to stand.

This invention provides a magnetic toner for developing an electrostatic image, comprising a binder resin, a magnetic material and an iron compound represented by the following formula (I):

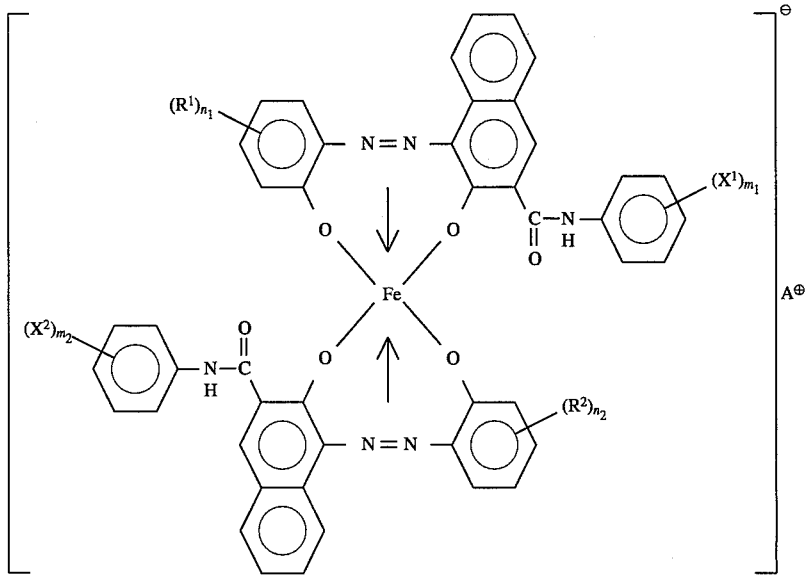

(I)

wherein $R^1$ and $R^2$ each represent a hydrogen atom, a sulfonic acid group, a carboxylic acid group, a carboxylate group, a hydroxyl group or a halogen atom, and may be the same or different; $n_1$ and $n_2$ each represent an integer of to 1 to 4; and $X^2$ each represent a hydrogen atom or a halogen atom; $m_1$ and $m_2$ each represent an integer of 1 to 3; and $A^{\oplus}$ represents a hydrogen ion, an alkali metal ion or an ammonium ion;

said magnetic toner having a saturation magnetization of from 20 $Am^2/kg$ to 50 $Am^2/kg$ and a coercive force of from 40 oersted to 200 oersted.

DETAILED DESCRIPTION OF THE PREFERRED EMBODIMENTS

Figure 1:
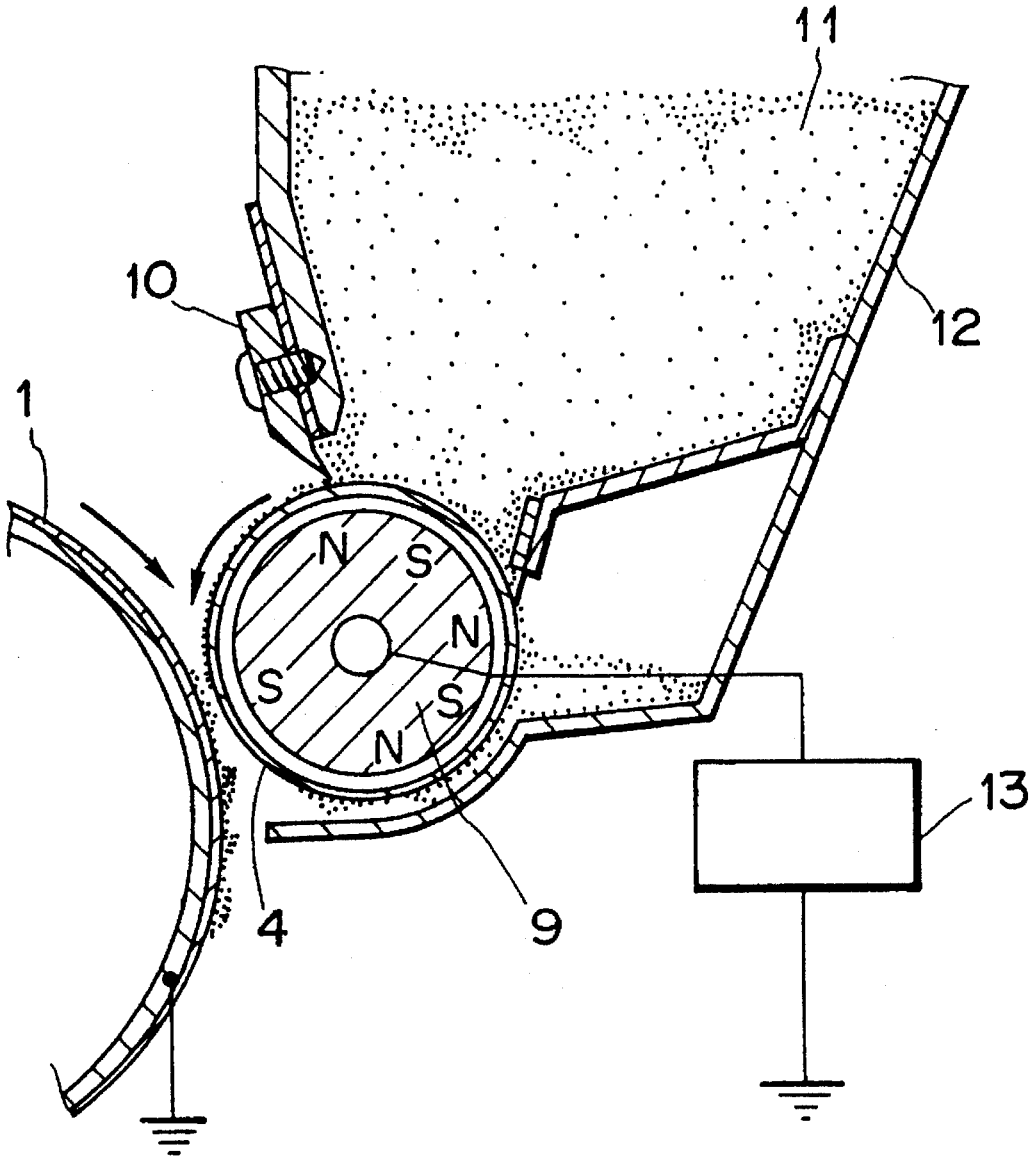
FIG. 1 illustrates an example of a developing assembly in which the magnetic toner of the present invention can be applied.

According to the studies made by the present inventors, it is important to properly balance the quantity of triboelectricity and magnetic properties of a magnetic toner in order to maintain the initial good image quality when the magnetic toner is used in one-component developing system. Based on such a finding, the present inventors studied various types of charge control agents in magnetic toner of various magnetic properties. As a result, they discovered that changes in particle size of magnetic materials that may occur as developing is repeated many times can be inhibited and the initial good image quality can be maintained when a specific iron compound is used in a toner for developing electrostatic images, where the toner has a saturation magnetization of from 20 to 50 $Am^2/kg$ and a coercive force of from 40 to 200 oersted. They have thus accomplished the present invention. The unit "$Am^2/kg$" is a unit in the International System of Units (SI) for measuring saturation magnetization in which A is "ampere", "m" is meter and "kg" is kilogram.

The iron compound used in the present invention is represented by the following formula (I). Formula (I)

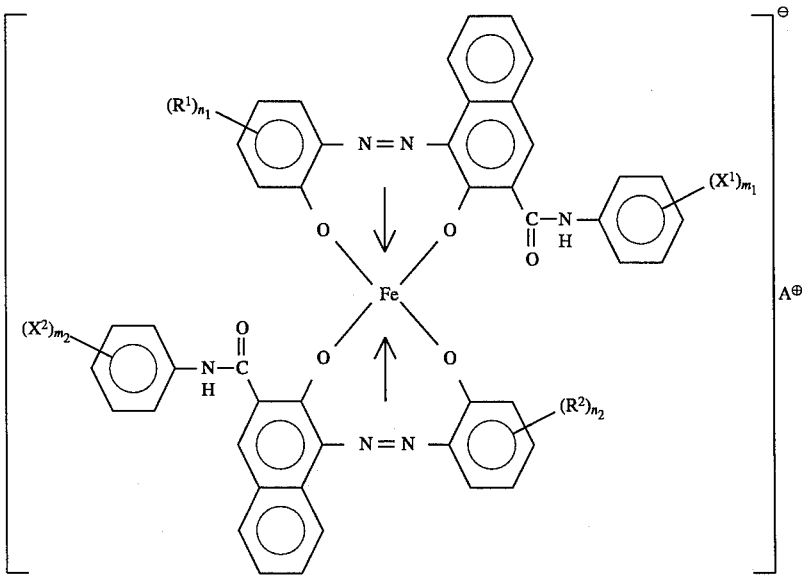

(I)

wherein $R^1$ and $R^2$ each represent a hydrogen atom, a sulfonic acid group, a carboxylic acid group, a carboxylate group, a hydroxyl group or a halogen atom, and may be the same or different; $n_1$ and $n_2$ each represent an integer of 1 to 4; $X^1$ and $X^2$ each represent a hydrogen atom or a halogen atom; $m_1$ and $m_2$ each represent an integer of 1 to 3; and $A^{\oplus}$ represents a hydrogen ion, an alkali metal ion or an ammonium ion;

$A^{\oplus}$ may preferably be an ammonium ion or be mainly composed of an ammonium ion (70 mol % or more). $A^{\oplus}$ may more preferably be a mixture of an ammonium ion and an alkali metal ion and/or a hydrogen ion, and be mainly composed of an ammonium ion. Still more preferably, in the above mixture, the ammonium ion may be in a content of from 80 to 98 mol %, and more preferably from 85 to 95 mol %.

According to the studies made by the present inventors, when the compound has ammonium ions and alkali metal ions or hydrogen ions in combination, the quantity of triboelectricity of the magnetic toner having been left to stand in an environment of high humidity can be restored to the original (i.e., before leaving to stand) quantity of triboelectricity, and also can be recovered more quickly with a stable image quality. On the other hand, when the compound has only protons or alkali metal ions as cations, the magnetic toner having been left in an environment of high humidity can be triboelectrically charged quickly, but the quantity of triboelectricity can not be well restored to the original quantity of triboelectricity, tending to cause a decrease in image density.

According to the studies made by the present inventors, a good compound that shows less deterioration even when left to stand over a long period of time can be obtained when ammonium ions and alkali metal ions or hydrogen ions are present together in the compound.

In particular, the rate and the level of restoration can be well maintained when ammonium ions are in a content of from 80 mol % to 98 mol %. If ammonium ions are in a content of less than 80 mol %, the restored level of triboelectricity may become a little lower than the original quantity of triboelectricity. On the other hand, if they are in a content more than 98 mol %, the rate of restoration may become lower. When the ammonium ions are in a content of from 85 mol % to 95 mol %, the rate of restoration preferably become higher. In addition, better results can be obtained also on restoration performance in an environment of high humidity.

The reason therefor is, according to the mechanism of ion conduction proposed as one of the mechanisms of triboelectric charging, presumed as follows:

It is presumed that when water content is relatively large as in the environment of high humidity, monovalent cations with small ion radii have high mobility so that charges once having leaked when the toner is left to stand can be quickly restored.

For that purpose, it is preferable for the alkali metal ions or hydrogen ions as the monovalent cations to be in a uniform content of at least 2 mol %, and more preferably at least 5 mol %.

In the present invention, the performance of restoration of the quantity of triboelectricity is expressed by a proportion of the restored charge to the original charge when a triboelectrically charged magnetic toner in an environment of high humidity is left to stand for a long period of time and thereafter shaken together with an iron powder carrier.

Stated specifically, 2.5 g of a magnetic toner and 47.5 g of an iron powder carrier are collected in a 50 $cm^3$ polyethylene container, and left to stand for 2 days in an environment of a temperature of 30° C. and a relative humidity of 80% RH in an uncovered state. These are then shaken in a tumbling mixer for 240 seconds, and thereafter about 0.5 g of the powdery mixture is collected to measure the quantity of triboelectricity of the magnetic toner by blowing-off. The measurement thus obtained is regarded as the original quantity of triboelectricity. The powdery mixture is further left to stand for 4 days in an uncovered state, followed by shaking in the tumbling mixer for 0, 60 or 240 seconds to measure the corresponding quantities of triboelectricity of the magnetic toner, and its percentage to the quantity of triboelectricity of the original magnetic toner is calculated.

Figure 2:
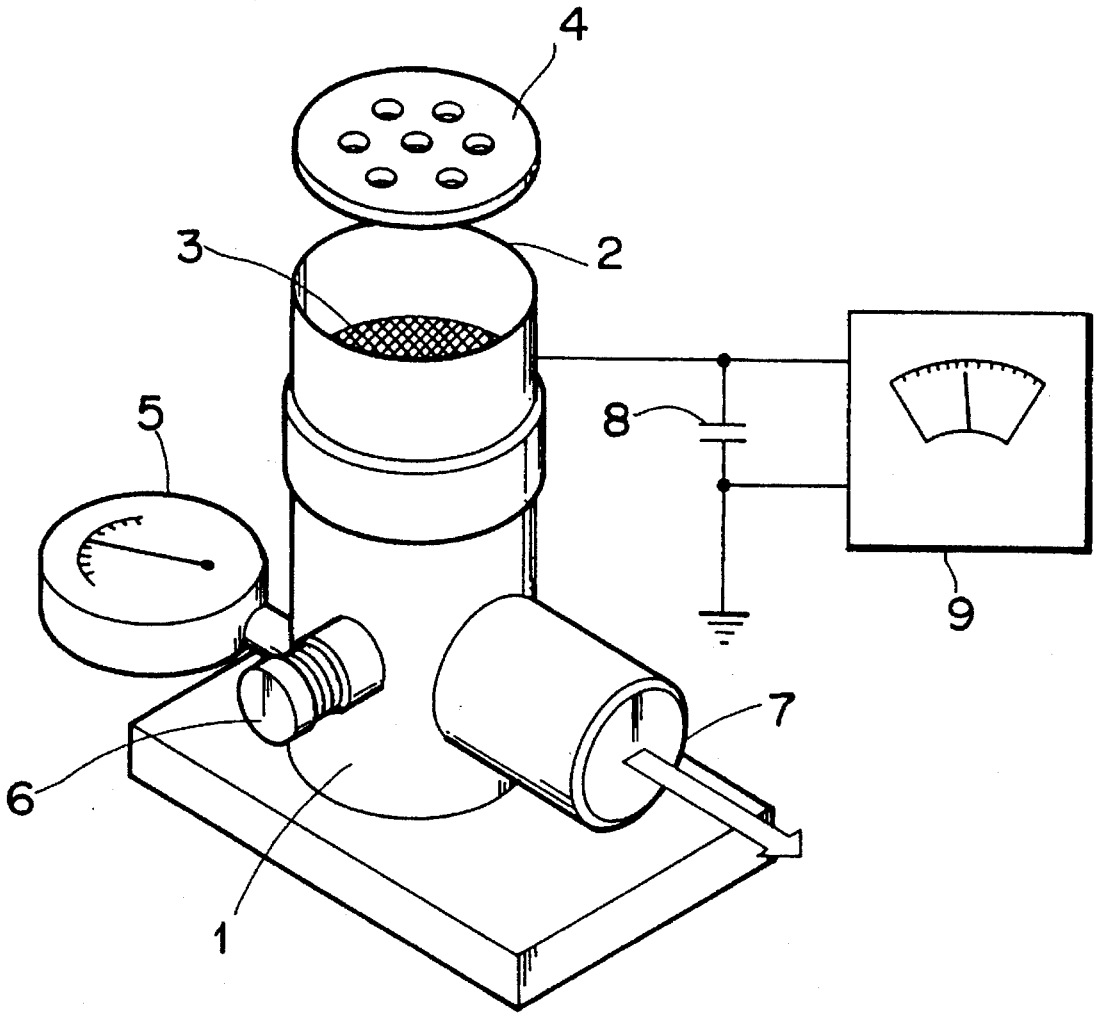
FIG. 2 schematically illustrates a measuring device for measuring quantity of triboelectricity of magnetic toners.

FIG. 2 illustrates an apparatus for measuring the quantity of triboelectricity. In a measuring container 2 made of a metal at the bottom of which is provided an electroconductive screen 3 of 500 meshes (appropriately changeable to the size the screen may not pass the carrier particles), the sample is put and the container is covered with a plate 4 made of a metal. Next, in a suction device 1 (made of an insulating material at least at the part coming into contact with the measuring container 2), air is sucked from a suction opening 7 and an air-flow control valve 6 is operated to control the pressure indicated by a vacuum indicator 5 to be 250 mmHg. In this state, suction is sufficiently carried out (for about 1 minute). The potential indicated by a potentiometer at this time is expressed by V (volt). Reference numeral 8 denotes a capacitor, whose capacitance is expressed by C (μF). The charges obtained therefrom are divided by the weight (g) of the magnetic toner removed by suction to obtain a value which is the quantity of triboelectricity (mC/Kg).

The magnetic toner of the present invention can also effectively prevent photosensitive members from being scraped. It can be presumed that, because of a good transfer rate of the magnetic toner of the present invention, the amount of the magnetic toner remaining on a photosensitive member after the step of transfer is sufficiently small to result in a small load in the step of cleaning. As can be also considered, the iron compound used in the present invention acts on the surface of the magnetic material to improve its state of dispersion in a resin, so that the magnetic material present on the surfaces of the magnetic toner particles has decreased.

In the present invention, complexes represented by formula (I) may be mixed to obtain the iron compound having the mixture of cations. A better shelf stability can be obtained when the iron compound is synthesized at one time while changing the percentage or pH of cationic components during its synthesis. This is presumably because the respective cations can be more uniformly dispersed and at the same time different cationic complexes can preferably interact, when the compound is synthesized at one time.

Examples of the iron compound represented by formula (I) are shown below.

Iron compound (1)

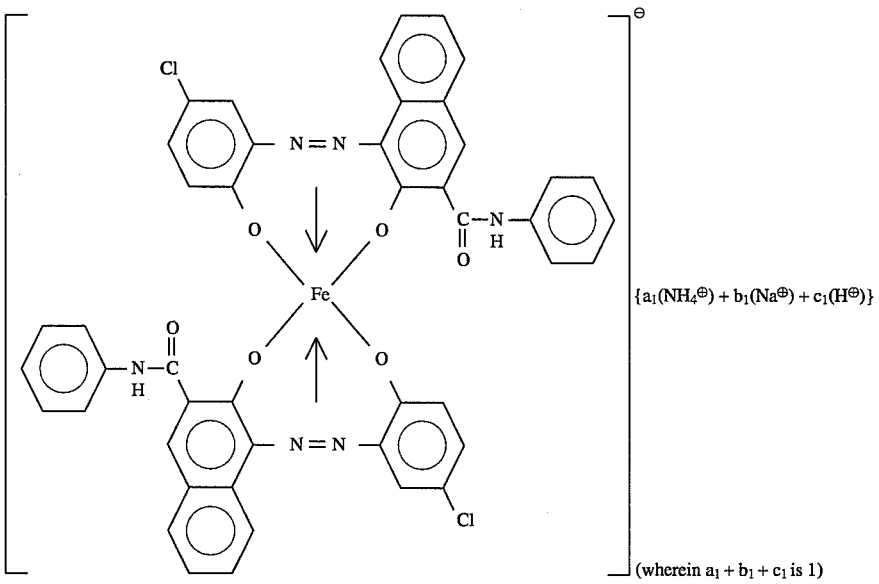

-continued
Iron compound (2)
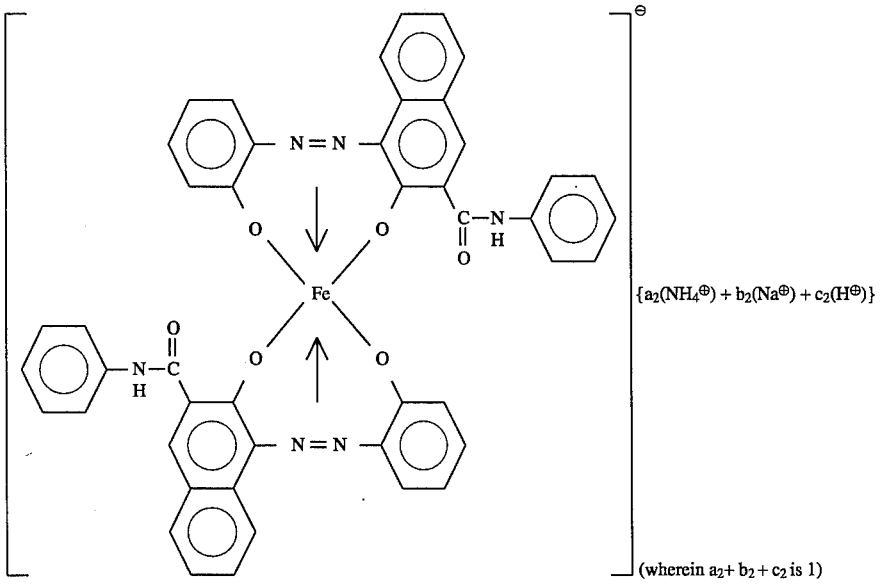
(wherein $a_2 + b_2 + c_2$ is 1)
Iron compound (3)
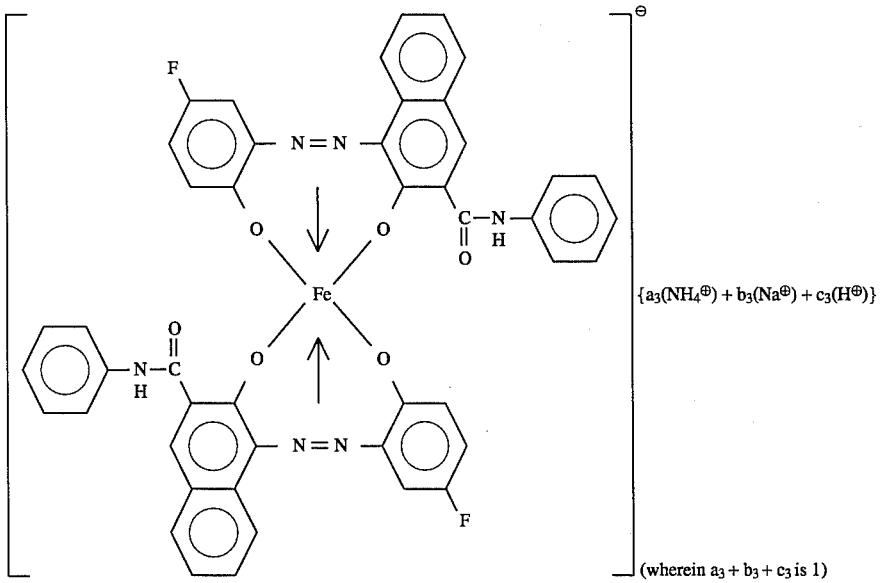
(wherein $a_3 + b_3 + c_3$ is 1)

-continued
Iron compound (4)
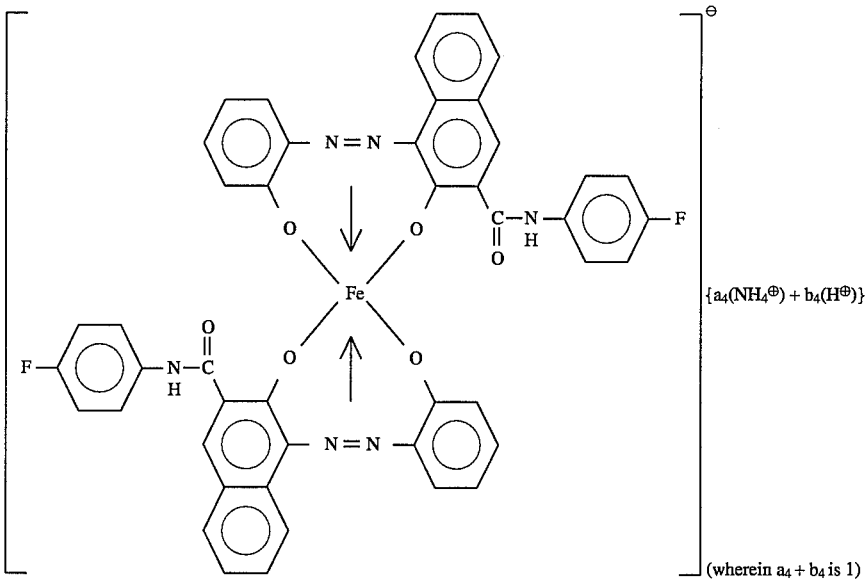
Iron compound (5)
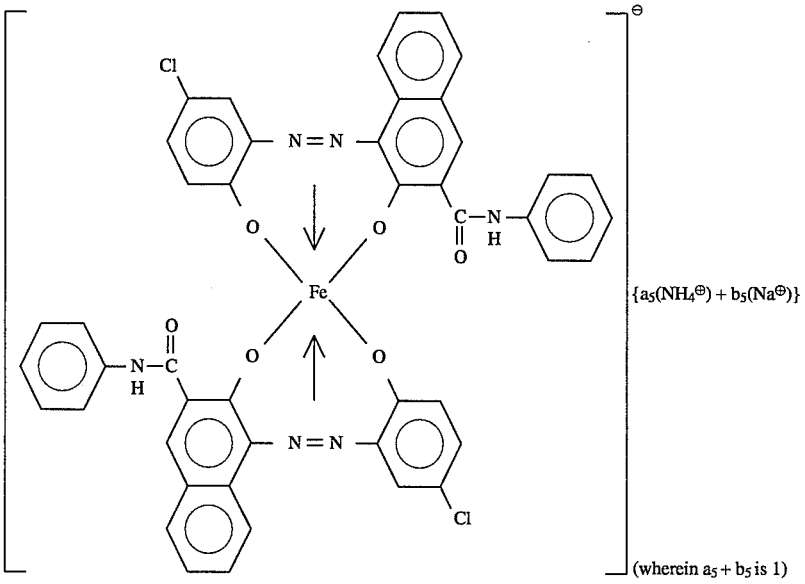

-continued
Iron compound (6)
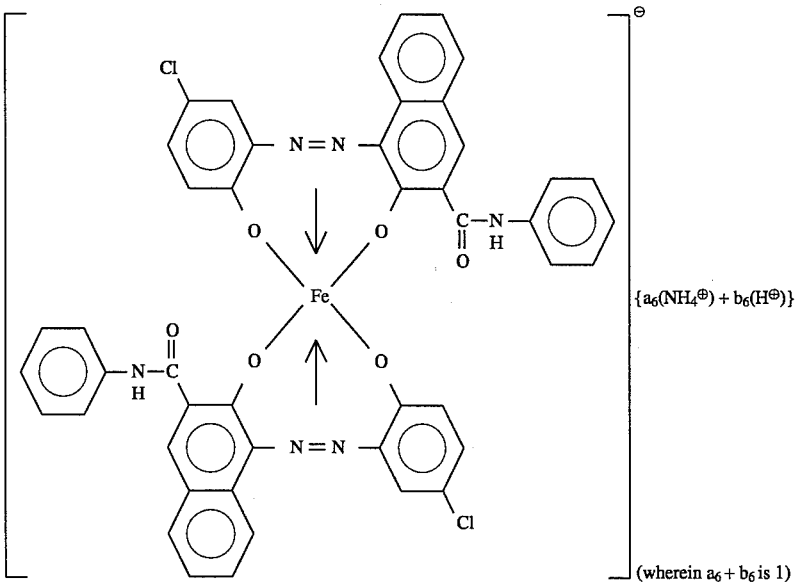
Iron compound (7)
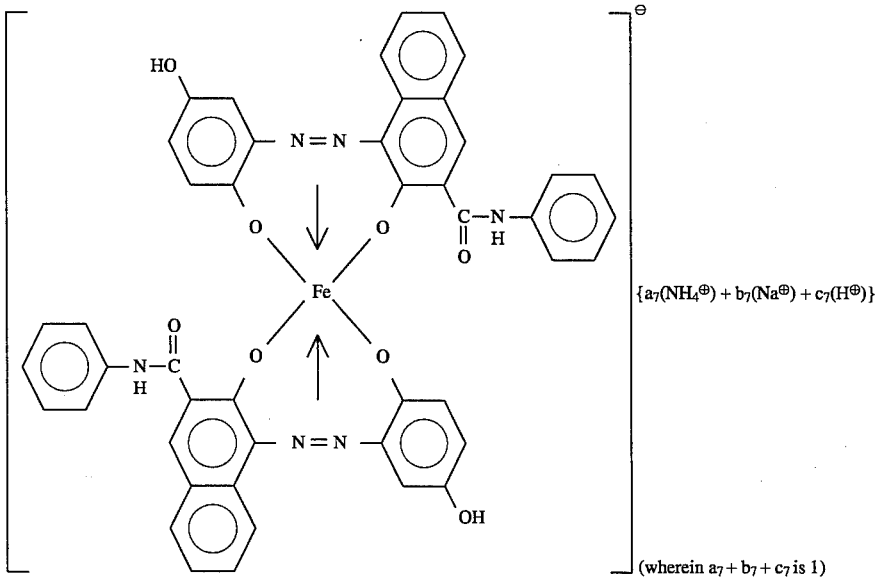

-continued
Iron compound (8)
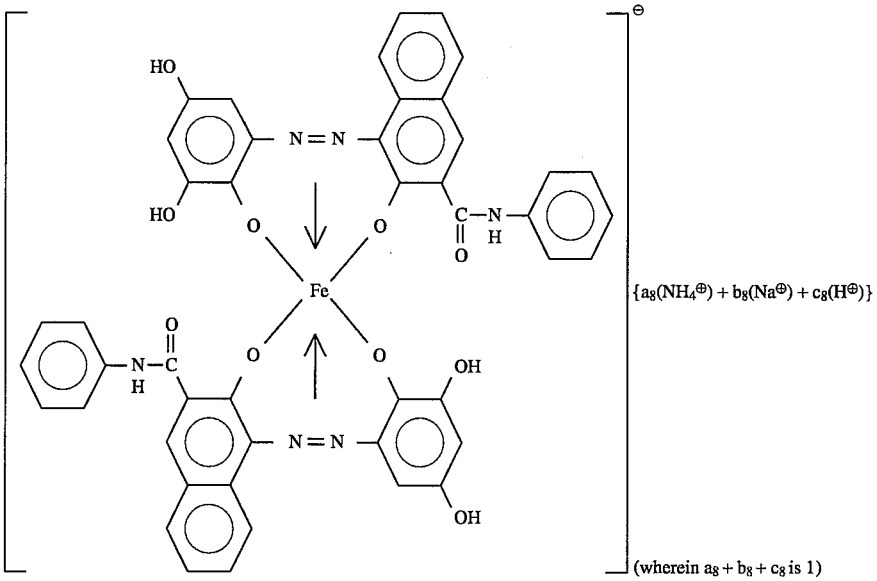
Iron compound (9)
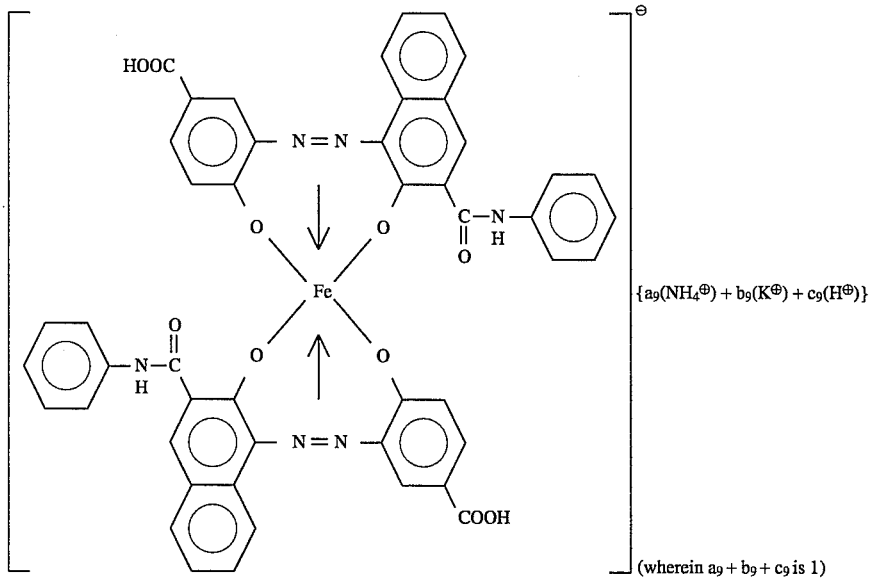

-continued

Iron compound (10)

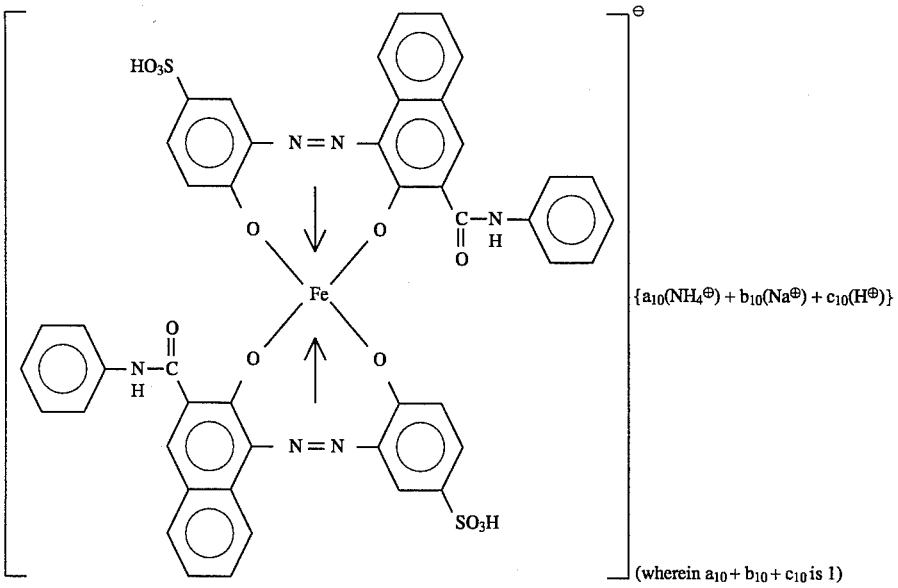

In the above exemplary iron compounds (1) to (10), $a_1$ through $a_{10}$ may preferably be 0.80 to 0.98; $b_1$ through $b_{10}$, 0.01 to 0.20; and $c_1$ through $c_{10}$, the balance. More preferably, $a_1$ through $a_{10}$ may be 0.85 to 0.95; $b_1$ through $b_{10}$, 0.01 to 0.05; and $c_1$ through $c_{10}$, the balance.

In the above iron compound (1), $a_1$ may preferably be 0.80 to 0.98; $b_1$, 0.01 to 0.19; and $c_1$, 0.01 to 0.19. More preferably, $a_1$ may be 0.85 to 0.95; $b_1$, 0.01 to 0.14; and $c_1$, 0.0.1 to 0.14.

Iron compound (11)

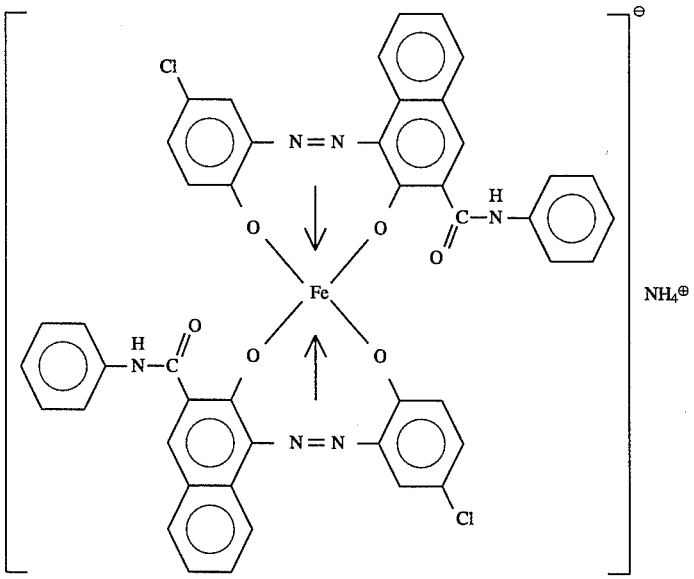

-continued
Iron compound (12)
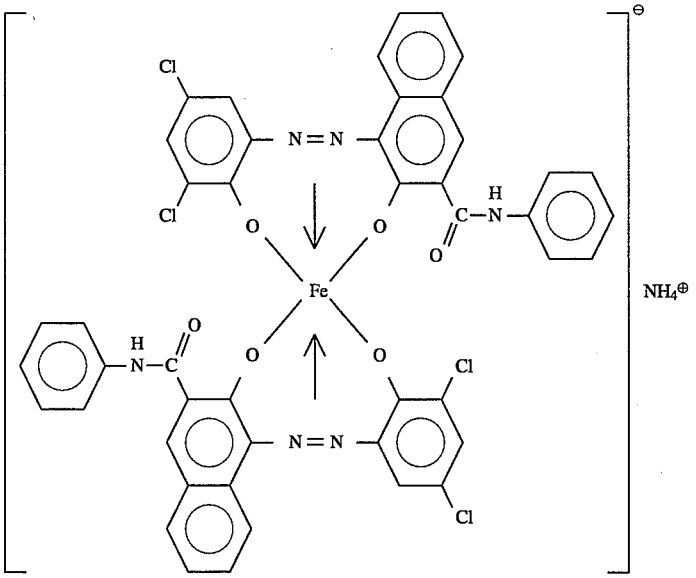
Iron compound (13)
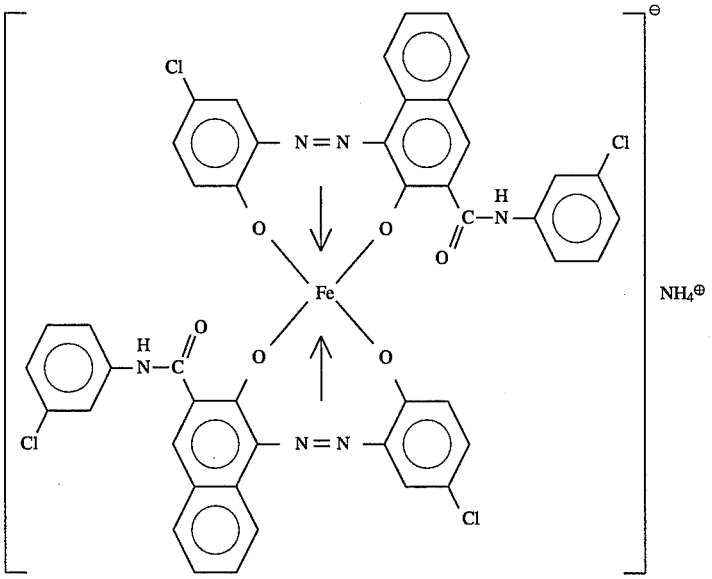

-continued
Iron compound (14)
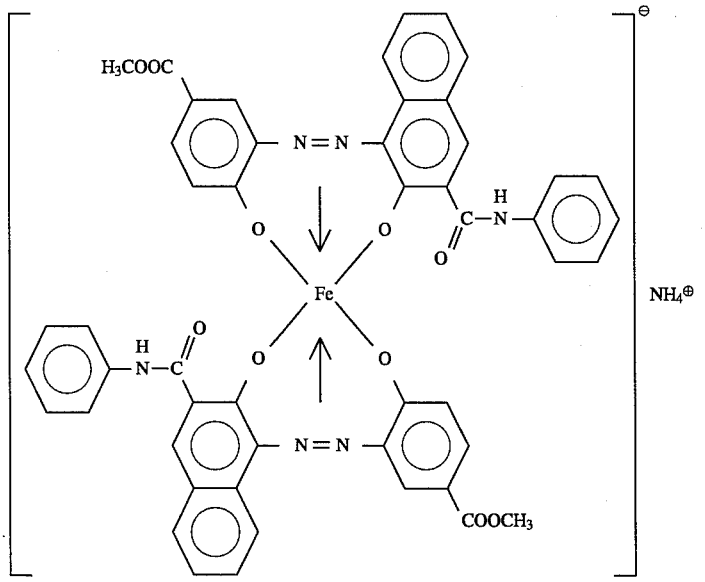
Iron compound (15)
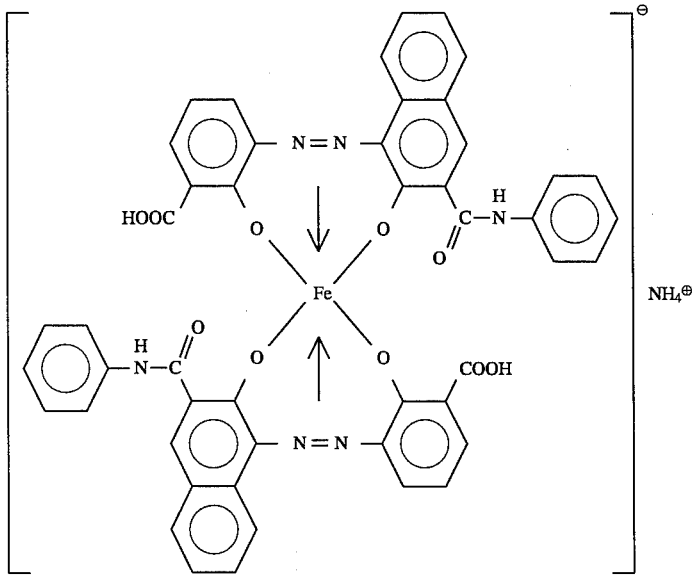

-continued

Iron compound (16)

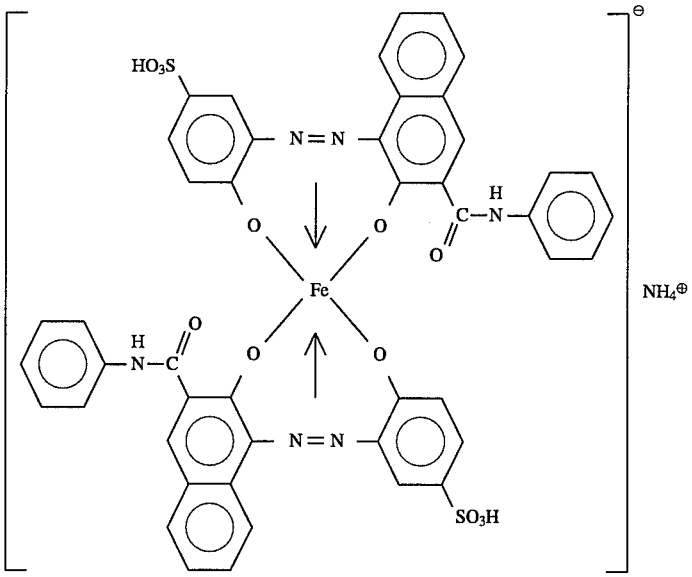

The iron compound can be incorporated into the toner by a method in which it is internally added to the inside of magnetic toner particles or externally added to the particles. The iron compound may preferably be used in an amount ranging from 0.1 part to 10 parts by weight, and more preferably from 0.1 part to 5 parts by weight, based on 100 parts by weight of the binder resin. When it is externally added, it may preferably be in an amount of from 0.01 part to 10 parts by weight, and more preferably from 0.01 part to 3 parts by weight, based on 100 parts by weight of the binder resin. In particular, it is preferred for iron compound particles to be mechanochemically fixed on the surfaces of the magnetic toner particles.

The iron compound used in the present invention may be used in combination with any conventionally known charge control agents so long as the effect of the iron compound is not damaged.

According to the studies made by the present inventors, in order to prevent the changes in particle size of magnetic toners that may occur during repeated developing, for the purpose of maintaining the initial high image quality, it is important to use the iron compound of the present invention and also make the saturation magnetization from 20 to 50 $Am^2/kg$ and a coercive force of from 40 to 200 oersted. In particular, it is preferable for the magnetic toner to have a saturation magnetization of from 25 to 40 $Am^2/kg$ and a coercive force of from 50 to 150 oersted.

As conventionally pointed out, magnetic toners come to have a low transport performance if their saturation magnetization is less than 20 $Am^2/kg$. In particular, the transport performance of coarse powder in a magnetic toner to a developing zone may become poor, tending to cause the coarse powder in the magnetic toner to accumulate in a developing assembly as developing is repeated many times. If the saturation magnetization is more than 50 $Am^2/kg$, the magnetic binding force on a developing sleeve increases, resulting, in particular, in a lowering of developing performance of the coarse powder. The cause thereof is not necessarily clear, but it is presumed as follows: The quantity of triboelectricity of a magnetic toner is considered proportional to the square of a particle diameter of the magnetic toner, and on the other hand the saturation magnetization is proportional to the cube of the same. Hence, particularly in the coarse powder of the magnetic toner, the magnetic binding force on the developing sleeve becomes larger than the quantity of triboelectricity, causing a lowering of developing performance and causing the coarse powder to accumulate.

As for the coercive force of the magnetic toner, the coarse powder tends to accumulate when it is more than 200 oersted.

For the measurement of magnetizing force, values at a magnetic field of 1 k oested are measured using, e.g., VSM, manufactured by Toei Kogyo K.K.

The magnetic material contained in the magnetic toner of the present invention may include iron oxides such as magnetite, γ-iron oxide, ferrite and iron-excess ferrite; metals such as iron, cobalt and nickel, or alloys of any of these with a metal such as aluminum, cobalt, copper, lead, magnesium, tin, zinc, antimony, beryllium, bismuth, cadmium, calcium, manganese, selenium, titanium, tungsten or vanadium, and mixtures of any of these.

These magnetic materials may preferably be those having an average particle diameter of from 0.1 to 1 μm, and preferably from 0.1 to 0.5 μm.

The magnetic material may preferably be contained in the magnetic toner in an amount that may satisfy the following expression.

$$MT=-(10/3)\times d+(70\pm15)$$

wherein MT represents a content (% by weight) of the magnetic material, and d represents a weight average particle diameter (μm) of the magnetic toner, provided that d is not more than 9 μm.

Use of the magnetic material in an amount less than the above limit may generally result in a low saturation magnetization of the magnetic toner, tending to cause lowering of the transport performance of the magnetic toner. As a result, the magnetic toner can not be fed to the developing zone in a sufficient quantity and hence only toner images with a low density can be obtained. On the other hand, if a magnetic material with a higher saturation magnetization is used in an amount less than the above limit to obtain a magnetic toner with a good transport performance, the toner has a high electrical resistivity because of the decrease of the magnetic material. As a result, when the iron compound of formula (I) is used, the quantity of triboelectricity becomes higher than the proper value tending to cause lowering of developing performance.

On the other hand, the use of the magnetic material in an amount more than the foregoing limit makes the saturation magnetization or coercive force of the magnetic toner excessively large, so that the fluidity of the magnetic toner may decrease or the magnetic binding force on the developing sleeve may increase. As a result, the developing performance of the magnetic toner may be lowered or the coarse powder of the magnetic toner may accumulate as developing is repeated many times, tending to cause lowering of image quality. An increase in the quantity of the magnetic material also result in a decrease in the quantity of triboelectricity of the magnetic material. Hence, this also can be the cause of a lowering of the developing performance of the magnetic tonerial.

Thus, in order to prevent the accumulation of the coarse powder as developing is repeated many times and to maintain the initial high image quality, it is important to control both the magnetic properties and the quantity of triboelectricity of the magnetic toner as described above. For that purpose, the quantity of triboelectricity of the magnetic toner must be controlled using the specific iron compound of formula (I) as a charge control agent, and on that occasion the amount of the magnetic material may preferably be within the range set out above.

In the magnetic toner of the present invention, the magnetic toner may preferably have a weight average particle diameter of from 3 to 9 μm. In particular, a magnetic toner having a weight average particle diameter of from 5 to 9 μm is preferred.

The particle size distribution of the magnetic toner can be measured by various methods. In the present invention, it is suitable to measure it using a Coulter counter.

A Coulter counter Type TA-II (manufactured by Coulter Electronics, Inc.) is used as a measuring device. The volume distribution and number distribution of particles of 2 μm to 40 μm are calculated by measuring the volume and number distribution of the toner particles, using an aperture of 100 μm as its aperture. Then the weight-based, weight average particle diameter $D_4$ is calculated from the volume distribution of the present invention (representative value of each channel is the median of each channel) and the weight-based, coarse-powder content is calculated from the volume distribution.

In the magnetic toner of the present invention, it is preferable to use a fine inorganic oxide powder by its external addition.

As the fine inorganic oxide powder, various materials can be used, as exemplified by silica, titanium oxide, aluminum oxide, cerium oxide and strontium titanate. In particular, those having metal ions with an electronegativity of from 10 to 15 are preferred in view of charging rate and environmental stability.

For the purpose such as imparting fluidity to the magnetic toner of the present invention, it is very preferable to externally add fine silica powder or fine titanium oxide powder.

The fine silica powder may include anhydrous silicon dioxide (silica), as well as silicates such as aluminum silicate, sodium silicate, potassium silicate, magnesium silicate and zinc silicate, any of which can be used.

Of the above fine silica powders, those having a specific surface area, as measured by the BET method using nitrogen absorption, of not less than 30 $m^2/g$, and particularly from 50 to 400 $m^2/g$, are preferred as base material silica.

Any of these fine silica powder, or those treated as described below, may preferably be used in an amount of from 0.01 part to 20% by weight, and particularly preferably from 0.03 part to 5% by weight, based on the weight of the magnetic toner.

The fine silica powder may be optionally treated with a treatment agent such as a silane coupling agent or an organic silicon compound, or with silicone oil or the like.

Such a treatment agent can be exemplified by hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilyl mercaptan, trimethylsilyl mercaptan, triorganosilyl acrylate, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and a dimethylpolysiloxane having 2 to 12 siloxane units in its molecule and containing a hydroxyl group bonded to each Si in its units positioned at the terminals. Any of these may be used alone or in the form of a mixture of two or more kinds.

When the treated fine silica powder has been made hydrophobic to such degree that it shows a hydrophobicity of a value ranging from 30 to 80 as measured by methanol titration, a magnetic toner containing such a fine silica powder is preferred since its quantity of triboelectricity comes to show a sharp and uniform positive chargeability. Here, the methanol titration is a test method to determine the hydrophobicity of fine silica powder whose surfaces have been made hydrophobic.

In order to evaluate the hydrophobicity of the treated fine silica powder, the "methanol titration" as defined in the present specification is carried out in the following way: 0.2 g of fine silica powder is added to 50 ml of water contained in a 250 ml Erlenmeyer flask. Methanol is dropwise added from a buret until the whole fine silica powder has been wetted. Here, the solution inside the flask is continually stirred using a magnetic stirrer. The end point can be observed upon suspension of the whole fine silica powder in the solution. The hydrophobicity is expressed as the percentage of the methanol present in the liquid mixture of methanol and water when the reaction has reached the end point.

The binder resin used in the present invention may include polystyrene; homopolymers of styrene derivatives such as poly-p-chlorostyrene and polyvinyltoluene; styrene copolymers such as a styrene/p-chlorostyrene copolymer, a styrene/vinyltoluene copolymer, a styrene/vinylnaphthalene copolymer, a styrene/acrylate copolymer, a styrene/methacrylate copolymer, a styrene/methyl α-chloromethacrylate copolymer, a styrene/acrylonitrile copolymer, a styrene/methyl vinyl ether copolymer, a styrene/ethyl vinyl ether copolymer, a styrene/methyl vinyl ketone copolymer, a styrene/butadiene copolymer, a styrene/isoprene copolymer and a styrene/acrylonitrile/indene copolymer; polyvinyl chloride, phenol resins, natural resin modified phenol resins, natural resin modified maleic acid resins, acrylic resins, methacrylic resins, polyvinyl acetate, silicone resins, polyester resins, polyurethane resins, polyamide resins, furan resins, epoxy resins, xylene resins, polyvinyl butyral, terpene resins, cumarone indene resins, and petroleum resins.

Cross-linked styrene copolymers are also preferable binder resins.

Comonomers copolymerizable with styrene monomers in styrene copolymers may include monocarboxylic acids having a double bond and derivatives thereof such as acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile and acrylamide; dicarboxylic acids having a double bond and derivatives thereof such as maleic acid, butyl maleate, methyl maleate and dimethyl maleate; vinyl esters such as vinyl acetate and vinyl benzoate; olefins such as ethylene, propylene and butylene; vinyl ketones such as methyl vinyl ketone and hexyl vinyl ketone; and vinyl ethers such as methyl vinyl ether, ethyl vinyl ether and isobutyl vinyl ether. Any of these vinyl monomers may be used alone or in combination of two or more.

As a cross-linking agent, compounds having at least two polymerizable double bonds are mainly used, which include, for example, aromatic divinyl compounds such as divinyl benzene and divinyl naphthalene; carboxylic acid esters having two double bonds such as ethylene glycol diacrylate, ethylene glycol dimethacrylate and 1,3-butanediol dimethacrylate; divinyl compounds such as divinyl apiline, divinyl ether, divinyl sulfide and divinyl sulfone; and compounds having at least three vinyl groups. Any of these may be used alone or in the form of a mixture. In particular, styrene copolymers having at least one peak of molecular weight distribution in the region of from $3\times10^3$ to $5\times10^4$ and at least one peak or shoulder in the region of $10^5$ or more as measured by gel permeation chromatography (GPC) are preferred.

The molecular weight distribution is measured by GPC under the following conditions.

Columns are stabilized in a heat chamber of 40° C. To the columns kept at this temperature, THF as a solvent is flowed at a flow rate of 1 ml per minute, and 100 μl of THF sample solution is injected thereinto to make measurement. In measuring the molecular weight of the sample, the molecular weight distribution of the sample is calculated from the relationship between the logarithmic value of the molecular weight and the count number of the eluate (a calibration curve) prepared using several kinds of monodisperse polystyrene standard samples. As the standard polystyrene samples used for the preparation of the calibration curve, it is suitable to use samples with molecular weights of from $10^2$ to $10^7$, which are available from Toso Co., Ltd. or Showa Denko KK., and to use at least about 10 standard polystyrene samples. An RI (refractive index) detector is used as a detector. Columns should be used in combination of a plurality of commercially available polystyrene gel columns. For example, they may preferably comprise a combination of Shodex GPC KF-801, KF-802, KF-803, KF-804, KF-805, KF-806, KF-807 and KF-800P, available from Showa Denko K.K.; or a combination of TSKgel G1000H($H_{XL}$), G2000H($H_{XL}$), G3000H($H_{XL}$), G4000H($H_{XL}$), G5000H($H_{XL}$), G6000H($H_{XL}$), G7000H($H_{XL}$) and TSK guard column, available from Toso Co., Ltd.

The sample is prepared in the following way:

The binder resin or the magnetic toner is put in THF, and is left to stand for several hours, followed by thorough shaking so as to be well mixed with the THF until coelescent matters of the sample has disappeared, which is further left to stand for at least 12 hours. At this time, the sample is so left as to stand in THF for at least 24 hours. Thereafter, the solution having been passed through a sample-treating filter (pore size: 0.45 to 0.5 μm; for example, MAISHORI DISK-25-5, available from Toso Co., Ltd. or EKICHRO DISK 25CR, available from German Science Japan, Ltd., can be utilized) is used as the sample for GPC. The sample is so adjusted to have resin components in a concentration of from 0.5 to 5 mg/ml.

When a pressure fixing system is employed, a pressure-fixable resin can be used. It may include, for example, polyethylenes, polypropylene, polymethylene, polyurethane elastomers, an ethylene/ethyl acrylate copolymer, an ethylene/vinyl acetate copolymer, ionomer resins, a styrene/butadiene copolymer, a styrene/isoprene copolymer, linear saturated polyesters, and paraffin.

The magnetic toner of the present invention may be optionally mixed with additives. The additives may include, for example, lubricants such as zinc stearate, abrasives such as cerium oxide and silicon carbide, fluidity-providing agents such as aluminum oxide, anti-caking agents, and conductivity-providing agents such as carbon black and tin oxide.

Fine fluorine-containing polymer powders such as fine polyvinylidene fluoride powder are also preferable additives in view of fluidity, abrasion and static charging stability.

For the purpose of improving releasability at the time of heat-roll fixing, it is one of preferred embodiments of the present invention to add to the toner a waxy material such as a low-molecular weight polyethylene, a low-molecular weight polypropylene, microcrystalline wax, carnuba wax, sasol wax and paraffin wax in an amount of from 0.5 to 5% by weight. In particular, sasol wax is one of preferred release agents.

The magnetic toner of the present invention may preferably be produced by a process comprising the steps of thoroughly mixing the magnetic toner component materials in a mixing machine such as a ball mill, well mixing the mixture by means of a heat kneading machine such as a heat roll kneader and an extruder, cooling the kneaded product to solidify, thereafter mechanically pulverizing the solidified product, and classifying the pulverized product to obtain a magnetic toner. Alternatively, the magnetic toner can also be produced by a method in which the component materials are dispersed in a binder resin solution, followed by spray drying to obtain a toner; a method in which given materials are mixed in monomers that constitute a binder resin to make up an emulsion dispersion, followed by polymerization to obtain a toner; and a method in which, in a microcapsule toner comprised of a core material and a shell material, given materials are incorporated into the core material or the shell material or into both of them. The magnetic toner can also be produced by a method in which desired additives and the magnetic toner are optionally further thoroughly blended by means of a mixing machine such as a Henschel mixer to obtain a magnetic toner.

The magnetic toner of the present invention can be well used to for development, to convert electrostatic images into visible images in electrophotography, electrostatic recording, electrostatic printing and so forth.

FIG. 1 shows an embodiment of a developing assembly in which the magnetic toner of the present invention can be applied.

An electrostatic image bearing member 1 is rotated in the direction of an arrow. A non-magnetic cylinder (a developing sleeve) 4 serving as a toner carrier member is rotated in the same direction as the electrostatic image bearing member 1 at a developing zone. The developing sleeve 4 is provided in its inside with a multi-polar permanent magnet 9. A magnetic toner 11 delivered from a toner container 12 is spread on the developing sleeve 4, and a magnetic blade 10 control the magnetic toner layer in a small and uniform thickness. In the developing zone, a DC bias voltage is applied to the developing sleeve 4 through a bias applying means 13. At this time, an AC bias may also be applied simultaneously. The AC bias when applied may preferably have a frequency of from 200 to 4,000 Hz and a potential difference between peaks, of from 3,000 to 5,000 V. In FIG. 1, the magnetic blade 10 is not in touch with the developing sleeve 4, but a blade made of an elastic material such as plastic or rubber may be in touch with it so that the magnetic toner layer thickness can be controlled.

EXAMPLES

The present invention will be described below in greater detail by giving Examples. These by no means limit the present invention. In the following formulation, "part(s)" refers to "part(s) by weight" in all occurrences.

Example 1

| | |
|---|---|
| Styrene/butyl methacrylate copolymer (weight average molecular weight: 250,000; first peak (peak 1): molecular weight 10,000; second peak (peak 2): molecular weight 70,000) | 100 parts |
| Magnetic material (average particle diameter: 0.2 μm; coercive force: 90 oersted) | 80 parts |
| Sasol wax | 3 parts |
| Iron compound (1) (molar ratio of $NH_4^{\oplus}$ to $Na^{\oplus}$ to $H^{\oplus}$: 0.9:0.05:0.05) | 2 parts |

The above materials were thoroughly premixed using a blender, and then kneaded using a twin-screw kneading extruder set to 130° C. The resulting kneaded product was cooled, and then crushed. Thereafter, the crushed product was finely pulverized using a fine grinding mill utilizing a jet stream. The resulting finely pulverized product was further put in a multi-division classifier utilizing the Coanda effect (Elbow Jet Classifier, manufactured by Nittetsu Kogyo Co.) to strictly classify and remove ultrafine powder and coarse powder at the same time. Thus, a black fine powder (a negatively chargeable magnetic toner) with a weight average particle diameter of 8.5 μm was obtained.

Then, 100 parts of the negatively chargeable magnetic toner thus obtained, 0.6 part of hydrophobic fine silica powder (average particle diameter: 15 nm) and 0.3 part of fine strontium titanate powder (average particle diameter: 1 μm) were mixed using a Henschel mixer to obtain a one-component magnetic toner. This magnetic toner had a saturation magnetization of 28 $Am^2/kg$ and a coercive force of 90 oersted.

The one-component magnetic toner obtained was applied in a commercially available electrophotographic copying machine NP-6060 (trade name; manufactured by Canon Inc.), and latent images were formed, followed by developing, transferring and fixing to make copying tests.

Copies were taken on 20,000 copy sheets in an environment of normal temperature and normal humidity, a temperature of 23° C. and a humidity of 60% RH. As a result, sharp images with an image density of 1.40±0.03 were obtained at the initial and following stages. With regard to resolution of images also, a resolution of 6.3 lines/mm at the initial stage was maintained.

Next, in an environment of low temperature and low humidity, a temperature of 15° C. and a humidity of 10% RH, a 20,000 sheet copying test was made. As a result, good images with an image density of 1.40±0.03 were obtained at the initial and following stages.

In an environment of high temperature and high humidity, a temperature of 30° C. and a humidity of 80% RH, a 10,000 sheet copying test was also made. As a result, good images with an image density of 1.35±0.03 were obtained at the initial and following stages. After the toner in the copying machine was left to stand for 4 days in the environment of high temperature and high humidity, copies were taken on 10,000 copy sheets. Good images with a density of 1.35±0.03 were obtained on the first and following copy sheets after copying was again started.

Restoration performance of the quantity of triboelectricity of the magnetic toner in the environment of high humidity is shown in Table 1.

Example 2

| | |
|---|---|
| Styrene/butyl methacrylate copolymer (weight average molecular weight: 250,000; first peak: molecular weight 10,000; second peak: molecular weight 70,000) | 100 parts |
| Magnetic material (average particle diameter: 0.2 μm; coercive force: 90 oersted) | 80 parts |
| Sasol wax | 3 parts |
| Iron compound (1) (molar ratio of $NH_4^{\oplus}$ to $Na^{\oplus}$ to $H^{\oplus}$: 0.98:0.01:0.01) | 2 parts |

A one-component magnetic toner was obtained in the same manner as in Example 1 except that the above materials were used. This magnetic toner had a saturation magnetization of 28 $Am^2/kg$ and a coercive force of 90 oersted.

The one-component magnetic toner obtained was applied in a commercially available electrophotographic copying machine NP-6060 (trade name; manufactured by Canon Inc.), and copying tests were made in the same manner as in Example 1.

Copies were taken on 20,000 copy sheets in an environment of a temperature of 23° C. and a humidity of 60% RH. As a result, sharp images with an image density of 1.40±0.03 were obtained at the initial and following stages. With regard to resolution of images also, a resolution of 6.3 lines/mm at the initial stage was maintained.

Next, in an environment of low temperature and low humidity, a temperature of 15° C. and a humidity of 10% RH, a 20,000 sheet copying test was made. As a result, good images with an image density of 1.40±0.03 were obtained at the initial and following stages.

In an environment of high temperature and high humidity, a temperature of 30° C. and a humidity of 80% RH, a 10,000 sheet copying test was also made. As a result, good images with an image density of 1.35±0.03 were obtained at the initial and following stages. After the toner in the copying machine was left to stand for 4 days in the environment of high temperature and high humidity, copies were taken on 10,000 copy sheets. On the first sheet after copying was again started, images had an image density of 1.30 which was a little lower than that obtained before the toner had been left, but good images with a density of 1.35±0.03 were obtained on the 10th and following copy sheets.

Restoration performance of the quantity of triboelectricity of the magnetic toner in the environment of high humidity is shown in Table 1.

Example 3

| | |
|---|---|
| Styrene/butyl methacrylate copolymer (weight average molecular weight: 250,000; first peak: molecular weight 10,000; second peak: molecular weight 70,000) | 100 parts |
| Magnetic material (average particle diameter: 0.2 μm; coercive force: 90 oersted) | 80 parts |
| Sasol wax | 3 parts |
| Iron compound (1) (molar ratio of $NH_4^{\oplus}$ to $Na^{\oplus}$ to $H^{\oplus}$: 0.8:0.15:0.05) | 2 parts |

A one-component magnetic toner was obtained in the same manner as in Example 1 except that the above materials were used. This magnetic toner had a saturation magnetization of 28 Am $^2$/kg and a coercive force of 90 oersted.

The one-component magnetic toner obtained was applied in a commercially available electrophotographic copying machine NP-6060 (trade name; manufactured by Canon Inc.), and copying tests were made in the same manner as in Example 1.

Copies were taken on 20,000 copy sheets in an environment of a temperature of 23° C. and a humidity of 60% RH. As a result, sharp images with an image density of 1.40±0.03 were obtained at the initial and following stages. With regard to resolution of images also, a resolution of 6.3 lines/mm at the initial stage was maintained.

Next, in an environment of low temperature and low humidity, a temperature of 15° C. and a humidity of 10% RH, a 20,000 sheet copying test was made. As a result, good images with an image density of 1.40±0.03 were obtained at the initial and following stages.

In an environment of high temperature and high humidity, a temperature of 30° C. and a humidity of 80% RH, a 10,000 sheet copying test was also made. As a result, good images with an image density of 1.35±0.03 were obtained at the initial and following stages. After the toner in the copying machine was left to stand for 4 days in the environment of high temperature and high humidity, copies were taken on 10,000 copy sheets. On the first sheet after copying was again started, images had an image density of 1.28 which was a little lower than that obtained before the toner had been left, but good images with a density of 1.35±0.03 were obtained on the 30th and following copy sheets.

Restoration performance of the quantity of triboelectricity of the magnetic toner in the environment of high humidity is shown in Table 1.

Example 4

| | |
|---|---|
| Styrene/butyl methacrylate copolymer (weight average molecular weight: 250,000; first peak: molecular weight 10,000; second peak: molecular weight 70,000) | 100 parts |
| Magnetic material (average particle diameter: 0.2 μm; coercive force: 90 oersted) | 80 parts |
| Sasol wax | 3 parts |
| Iron compound (1) (molar ratio of $NH_4^{\oplus}$ to $Na^{\oplus}$ to $H^{\oplus}$: 0.5:0.2:0.3) | 2 parts |

A one-component magnetic toner was obtained in the same manner as in Example 1 except that the above materials were used. This magnetic toner had a saturation magnetization of 28 $Am^2$/kg and a coercive force of 90 oersted.

The one-component magnetic toner obtained was applied in a commercially available electrophotographic copying machine NP-6060 (trade name; manufactured by Canon Inc.), and copying tests were made in the same manner as in Example 1.

Copies were taken on 20,000 copy sheets in an environment of a temperature of 23° C. and a humidity of 60% RH. As a result, sharp images with an image density of 1.40±0.03 were obtained at the initial and following stages. With regard to resolution of images also, a resolution of 6.3 lines/mm at the initial stage was maintained.

Next, in an environment of low temperature and low humidity, a temperature of 15° C. and a humidity of 10% RH, a 20,000 sheet copying test was made. As a result, good images with an image density of 1.40±0.03 were obtained at the initial and following stages.

In an environment of high temperature and high humidity, a temperature of 30° C. and a humidity of 80% RH, a 10,000 sheet copying test was also made. As a result, good images with an image density of 1.35±0.03 were obtained at the initial and following stages. After the toner in the copying machine was left to stand for 4 days in the environment of high temperature and high humidity, copies were taken on 10,000 copy sheets. On the first sheet after copying was again started, images had an image density of 1.25 which was a little lower than that obtained before the toner had been left, but good images with a density of 1.30±0.03 were obtained on the 30th and following copy sheets.

Restoration performance of the quantity of triboelectricity of the magnetic toner in the environment of high humidity is shown in Table 1.

Example 5

A one-component magnetic toner was obtained in the same manner as in Example 1 except that the amount of the magnetic material was changed to 120 parts. This magnetic toner had a saturation magnetization of 42 $Am^2$/kg and a coercive force of 90 oersted.

The one-component magnetic toner obtained was applied in a commercially available electrophotographic copying machine NP-6060 (trade name; manufactured by Canon Inc.), and copying tests were made in the same manner as in Example 1.

Copies were taken on 20,000 copy sheets in an environment of a temperature of 23° C. and a humidity of 60% RH. As a result, sharp images with an image density of 1.35±0.03 were obtained at the initial and following stages. With regard to resolution of images also, a resolution of 6.3 lines/mm at the initial stage was maintained.

Next, in an environment of low temperature and low humidity, a temperature of 15° C. and a humidity of 10% RH, a 20,000 sheet copying test was made. As a result, good images with an image density of 1.40±0.03 were obtained at the initial and following stages.

In an environment of high temperature and high humidity, a temperature of 30° C. and a humidity of 80% RH, a 10,000 sheet copying test was also made. As a result, good images with an image density of 1.30±0.03 were obtained at the initial and following stages. After the toner in the copying machine was left to stand for 4 days in the environment of high temperature and high humidity, copies were taken on 10,000 copy sheets. Good images with a density of 1.30±0.03 were obtained on the first and following copy sheets after copying was again started.

Restoration performance of the quantity of triboelectricity of the magnetic toner in the environment of high humidity is shown in Table 1.

Example 6

A one-component magnetic toner was obtained in the same manner as in Example 1 except that the iron compound (1) was replaced with 3 parts of an iron compound represented by formula (17) shown below. This magnetic toner had a saturation magnetization of 28 $Am^2/kg$ and a coercive force of 90 oersted.

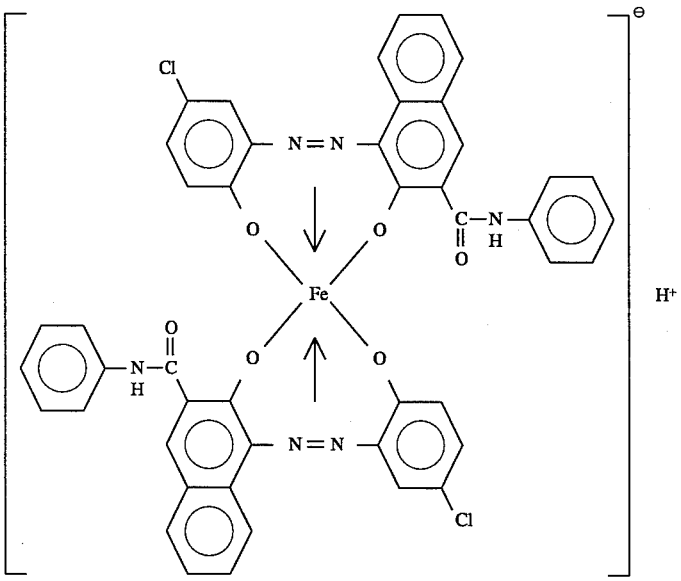

(17)

The one-component magnetic toner obtained was applied in a commercially available electrophotographic copying machine NP-6060 (trade name; manufactured by Canon Inc.), and copying tests were made in the same manner as in Example 1.

Copies were taken on 20,000 copy sheets in an environment of a temperature of 23° C. and a humidity of 60% RH. As a result, sharp images with an image density of 1.35±0.05 were obtained at the initial and following stages. With regard to resolution of images also, a resolution of 6.3 lines/mm at the initial stage was maintained.

Next, in an environment of low temperature and low humidity, a temperature of 15° C. and a humidity of 10% RH, a 20,000 sheet copying test was made. As a result, good images with an image density of 1.40±0.05 were obtained at the initial and following stages.

In an environment of high temperature and high humidity, a temperature of 30° C. and a humidity of 80% RH, a 10,000 sheet copying test was also made. As a result, good images with an image density of 1.25±0.05 were obtained at the initial and following stages. After the toner in the copying machine was left to stand for 4 days in the environment of high temperature and high humidity, copies were taken on 10,000 copy sheets. However, on the first sheet after copying was again started, images had an image density of 1.05 which was lower than that obtained before the toner had been left. Also after copying on the 100th sheet, images had an image density of 1.20±0.05, which was inferior to the images obtained before the toner had been left.

Restoration performance of the quantity of triboelectricity of the magnetic toner in the environment of high temperature and high humidity is shown in Table 1.

Example 7

A one-component magnetic toner was obtained in the same manner as in Example 1 except that the styrene/butyl methacrylate copolymer was replaced with polyester resin (weight average molecular weight: 20,000) was used. This magnetic toner had a saturation magnetization of 28 $Am^2/kg$ and a coercive force of 90 oersted.

The one-component magnetic toner obtained was applied in a commercially available electrophotographic copying machine NP-6060 (trade name; manufactured by Canon Inc.), and copying tests were made in the same manner as in Example 1.

Copies were taken on 20,000 copy sheets in an environment of a temperature of 23° C. and a humidity of 60% RH. As a result, sharp images with an image density of 1.40±0.03 were obtained at the initial and following stages. With regard to resolution of images also, a resolution of 6.3 lines/mm at the initial stage was maintained.

Next, in an environment of low temperature and low humidity, a temperature of 15° C. and a humidity of 10% RH, a 20,000 sheet copying test was made. As a result, good images with an image density of 1.40±0.03 were obtained at the initial and following stages.

In an environment of high temperature and high humidity, a temperature of 30° C. and a humidity of 80% RH, a 10,000 sheet copying test was also made. As a result, good images with an image density of 1.35±0.03 were obtained at the initial and following stages. After the toner in the copying machine was left to stand for 4 days in the environment of high temperature and high humidity, copies were taken on 10,000 copy sheets. Good images with a density of 1.35±0.03 were obtained on the first and following copy sheets after copying was again started.

Restoration performance of the quantity of triboelectricity of the magnetic toner in the environment of high temperature and high humidity is shown in Table 1.

Example 8

| | |
|---|---|
| Styrene/butyl methacrylate copolymer (weight average molecular weight: 300,000; first peak: molecular weight 6,000; second peak: molecular weight 100,000) | 100 parts |
| Magnetic material (average particle diameter: 0.2 μm; coercive force: 90 oersted) | 100 parts |
| Low-molecular weight polypropylene wax | 3 parts |
| Iron compound (1) (molar ratio of $NH_4^{\oplus}$ to $Na^{\oplus}$ to $H^{\oplus}$: 0.92:0.04:0.04) | 2 parts |

The above materials were thoroughly premixed using a blender, and then kneaded using a twin-screw kneading extruder set to 130° C. The resulting kneaded product was cooled, and then crushed. Thereafter, the crushed product was finely pulverized using a fine grinding mill utilizing a jet stream. The resulting finely pulverized product was further put in a multi-division classifier utilizing the Coanda effect (Elbow Jet Classifier, manufactured by Nittetsu Kogyo Co.) to strictly classify and remove ultrafine powder and coarse powder at the same time. Thus, a black fine powder (a negatively chargeable magnetic toner) with a weight average particle diameter of 6.5 μm was obtained. This magnetic toner had a saturation magnetization of 28 $Am^2/kg$ and a coercive force of 90 oersted.

Then, 100 parts of the magnetic toner thus obtained and 1 part of hydrophobic fine silica powder (average particle diameter: 15 nm) were mixed using a Henschel mixer to obtain a one-component magnetic toner.

The one-component magnetic toner obtained was applied in a commercially available laser beam printer LBP-KT (trade name; manufactured by Canon Inc.) to make printing tests.

Prints were obtained on 6,000 copy sheets in an environment of a temperature of 23° C. and a humidity of 60% RH. As a result, sharp images with an image density of 1.40±0.03 were obtained at the initial and following stages.

Next, in an environment of low temperature and low humidity, a temperature of 15° C. and a humidity of 10% RH, a 6,000 sheet printing test was made. As a result, good images with an image density of 1.40±0.03 were obtained at the initial and following stages.

In an environment of high temperature and high humidity, a temperature of 30° C. and a humidity of 80% RH, a 3,000 sheet printing test was also made. As a result, good images with an image density of 1.35±0.03 were obtained at the initial and following stages. After the toner in the printer was left to stand for 4 days in the environment of high temperature and high humidity, prints were obtained on 3,000 copy sheets. Good images with a density of 1.35±0.03 were obtained on the first and following copy sheets after printing was again started, where no decrease in image density due to the toner having been left to stand was seen.

Restoration performance of the quantity of triboelectricity of the magnetic toner in the environment of high temperature and high humidity is shown in Table 1.

Example 9

A one-component magnetic toner was obtained in the same manner as in Example 8 except that the iron compound (1) was replaced with 1 part of the iron compound (2) (molar ratio of $NH_4^{\oplus}$ to $Na^{\oplus}$ to $H^{\oplus}$: 0.93:0.04:0.03). This magnetic toner had a saturation magnetization of 28 $Am^2/kg$ and a coercive force of 90 oersted.

The one-component magnetic toner obtained was applied in a commercially available laser beam printer LBP-KT (trade name; manufactured by Canon Inc.) to make printing tests.

Prints were obtained on 6,000 copy sheets in an environment of a temperature of 23° C. and a humidity of 60% RH. As a result, sharp images with an image density of 1.40±0.05 were obtained at the initial and following stages.

Next, in an environment of low temperature and low humidity, a temperature of 15° C. and a humidity of 10% RH, a 6,000 sheet printing test was made. As a result, good images with an image density of 1.40±0.05 were obtained at the initial and following stages.

In an environment of high temperature and high humidity, a temperature of 30° C. and a humidity of 80% RH, a 3,000 sheet printing test was also made. As a result, good images with an image density of 1.35±0.05 were obtained at the initial and following stages. After the toner in the printer was left to stand for 4 days in the environment of high temperature and high humidity, prints were obtained on 3,000 copy sheets. Good images with a density of 1.35±0.05 were obtained on the first and following copy sheets after printing was again started, where no decrease in image density due to the toner having been left to stand was seen.

Restoration performance of the quantity of triboelectricity of the magnetic toner in the environment of high temperature and high humidity is shown in Table 1.

Example 10

| | |
|---|---|
| Styrene/butyl methacrylate copolymer (weight average molecular weight: 250,000; first peak: molecular weight 10,000; second peak: molecular weight 70,000) | 100 parts |
| Magnetic material (average particle diameter: 0.2 μm; coercive force: 140 oersted) | 80 parts |
| Sasol wax | 3 parts |
| Iron compound (11) | 2 parts |

The above materials were thoroughly premixed using a blender, and then kneaded using a twin-screw kneading extruder set to 130° C. The resulting kneaded product was cooled, and then crushed. Thereafter, the crushed product was finely pulverized using a fine grinding mill utilizing a jet stream. The resulting finely pulverized product was further put in a multi-division classifier utilizing the Coanda effect (Elbow Jet Classifier, manufactured by Nittetsu Kogyo Co.) to strictly classify and remove ultrafine powder and coarse powder at the same time. Thus, a black fine powder (a negatively chargeable magnetic toner) with a weight average particle diameter of 8.5 μm was obtained.

This magnetic toner had a saturation magnetization of 28 Am /kg and a coercive force of 140 oersted.

Then, 100 parts of the magnetic toner thus obtained and 0.6 part of hydrophobic fine silica powder (BET specific surface area: 200 $m^2/g$) were mixed using a Henschel mixer to obtain a one-component magnetic toner with an average particle diameter of 8.5 μm, having the hydrophobic fine silica powder.

The one-component magnetic toner obtained was applied in a commercially available electrophotographic copying machine NP-6060 (trade name; manufactured by Canon Inc.), and a 20,000 sheet copying test was made in an environment of normal temperature and normal humidity.

Sharp images with an image density of 1.40 were obtained at the initial and following stages. Images after 20,000 sheet copying also had sharp images with a density of 1.39. With regard to resolution of images also, a resolution of 6.3 lines/mm at the initial stage was maintained.

The quantity of triboelectricity of the magnetic toner was measured by blowing-off to ascertain that it was −10.8 μc/g. The coarse powder with a particle diameter larger than 10.8 μm was in a quantity of 25% by weight before copying, and 28% by weight after the copying, between which there was little change.

Next, in an environment of low temperature and low humidity, a temperature of 15° C. and a humidity of 10% RH, a 20,000 sheet copying test was made. As a result, good images with an image density of 1.38±0.03 were obtained at the initial and following stages.

In an environment of high temperature and high humidity, a temperature of 30° C. and a humidity of 80% RH, a 10,000 sheet copying test was also made. As a result, good images with an image density of 1.32±0.03 were obtained at the initial and following stages. Subsequently, after the toner in the copying machine was left to stand for 4 days in the environment of high temperature and high humidity, copies were taken on 10,000 copy sheets. Good images with a density of 1.32±0.03 were obtained on the first and following copy sheets after copying was again started.

Restoration performance of the quantity of triboelectricity of the magnetic toner in the environment of high humidity is shown in Table 1.

Example 11

Example 1 was repeated to obtain a magnetic toner with a weight average particle diameter of 8.5 μm, except that a magnetic material (average particle diameter: 0.2 μm; coercive force: 180 oersted) with a higher coercive force than that in Example 10 was used. The magnetic toner obtained had a saturation magnetization of 33 $Am^2/kg$ and a coercive force of 180 oersted.

On the magnetic toner thus obtained, copying tests were made in the same manner as in Example 10.

As a result, sharp images with an image density of 1.41 were obtained at the initial and following stages. Images after 20,000 sheet copying also had sharp images with a density of 1.37. With regard to resolution of images, however, it was 6.3 lines/mm at the initial stage, but lowered to 5.6 lines/mm after 20,000 sheet copying.

The quantity of triboelectricity of the magnetic toner was measured by blowing-off to ascertain that it was −11.3 μc/g. The coarse powder with a particle diameter larger than 10.8 μm was in a quantity of 23% by weight before copying, and 30% by weight after 20,000 sheet copying, between which there was a little increase.

Next, in an environment of low temperature and low humidity, a temperature of 15° C. and a humidity of 10% RH, a 20,000 sheet copying test was made. As a result, good images with an image density of 1.35±0.03 were obtained at the initial and following stages.

In an environment of high temperature and high humidity, a temperature of 30° C. and a humidity of 80% RH, a 10,000 sheet copying test was also made. As a result, good images with an image density of 1.31±0.03 were obtained at the initial and following stages. Subsequently, after the toner in the copying machine was left to stand for 4 days in the environment of high temperature and high humidity, copies were taken on 10,000 copy sheets. Good images with a density of 1.31±0.03 were obtained on the first and following copy sheets after copying was again started.

Restoration performance of the quantity of triboelectricity of the magnetic toner in the environment of high humidity is shown in Table 1.

Comparative Example 1

A one-component magnetic toner was obtained in the same manner as in Example 10 except that the iron compound (11) was replaced with the iron compound (18) of the formula:

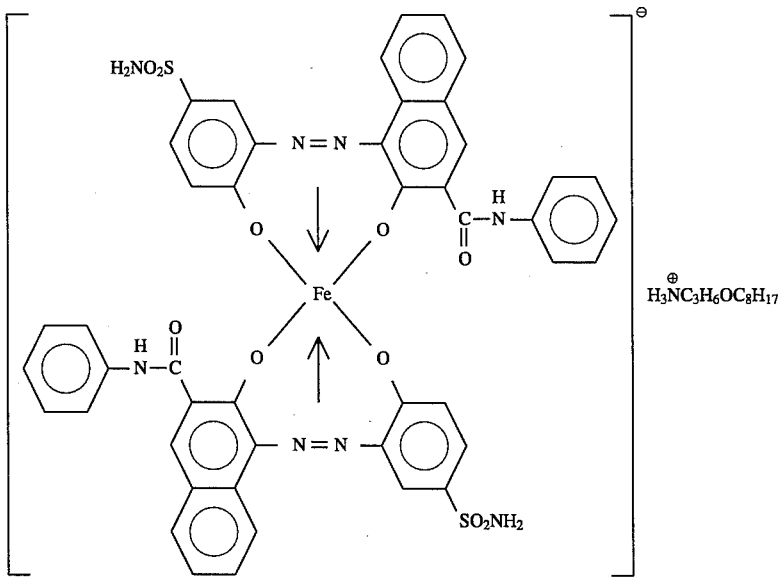

This one-component magnetic toner had a saturation magnetization of 28 Am $^2$/kg and a coercive force of 140 oersted.

The obtained magnetic toner was used to conduct a copying test in the same manner as in Example 11.

Sharp images with an image density of 1.37 were obtained at the initial stage of copying, but images after 20,000 sheet copying had a lowered image density of 1.25. With regard to resolution of images also, it was 6.3 lines/mm at the initial stage, but it was lowered to 4.5 lines/mm after 20,000 sheet copying. The quantity of triboelectricity of the magnetic toner was measured by blowing-off to ascertain that it was −9.3 μc/g. The coarse powder with a particle diameter larger than 10.8 μm was in a quantity of 25% by weight before copying, and it increased to 39% by weight after 20,000 sheet copying.

Next, in an environment of low temperature and low humidity, a temperature of 15° C. and a humidity of 10% RH, a 20,000 sheet copying test was made. As a result, an initial image density of 1.35 decreased to 1.21.

In an environment of high temperature and high humidity, a temperature of 30° C. and a humidity of 80% RH, a 10,000 sheet copying test was also made. As a result, an initial image density of 1.25 lowered to 1.1. Restoration performance of the quantity of triboelectricity of the magnetic toner in the environment of high humidity is shown in Table 1.

Comparative Example 2

A one-component magnetic toner was obtained in the same manner as in Example 10 except that the iron compound (11) was replaced with the iron compound (19) of the formula:

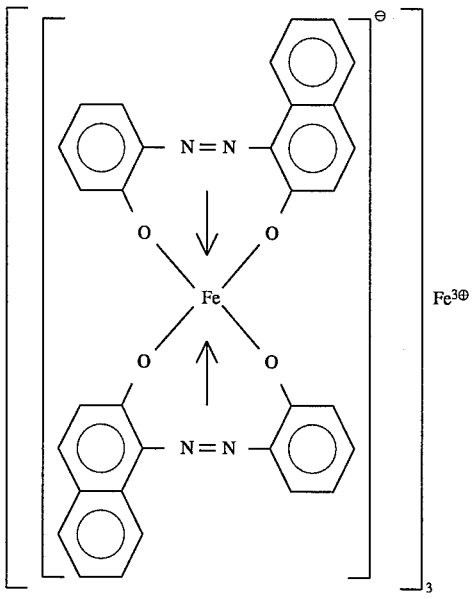

This magnetic toner had a saturation magnetization of 28 Am$^2$/kg and a coercive force of 140 oersted.

The obtained magnetic toner was used to conduct a copying test in the same manner as in Example 10.

Sharp images with an image density of 1.35 were obtained at the initial stage of copying, but after 20,000 sheet copying, the image density lowered to 1.21. With regard to resolution of images also, it was 6.3 lines/mm at the initial stage, but it was lowered to 4.0 lines/mm after 20,000 sheet copying. The quantity of triboelectricity of the magnetic toner was measured by blowing-off to ascertain that it was −8.8 μc/g. The coarse powder with a particle diameter larger than 10.8 μm was in a quantity of 27% by weight before copying, and it increased to 43% by weight after 20,000 sheet copying.

Next, in an environment of low temperature and low humidity, a temperature of 15° C. and a humidity of 10% RH, a 20,000 sheet copying test was made. As a result, an initial image density of 1.35 decreased to 1.23.

In an environment of high temperature and high humidity, a temperature of 30° C. and a humidity of 80% RH, a 10,000 sheet copying test was also made. As a result, an initial image density of 1.15 lowered to 1.00. Restoration performance of the quantity of triboelectricity of the magnetic toner in the environment of high humidity is shown in Table 1.

Comparative Example 3

A one-component magnetic toner was obtained in the same manner as in Example 10 except that a magnetic material having a coercive force (300 oersted) higher than in Example 11. The one-component magnetic toner had a saturation magnetization of 31 Am$^2$/kg and a coercive force of 300 oersted.

The obtained one-component magnetic toner was used to conduct a copying test in the same manner as in Example 10.

Sharp images with an image density of 1.39 were obtained at the initial stage of copying, but after 20,000 sheet copying, the image density lowered to 1.22. With regard to resolution of images, it was 6.3 lines/mm at the initial stage, but it was lowered to 4.5 lines/mm after 20,000 sheet copying. The quantity of triboelectricity of the magnetic toner was measured by blowing-off to ascertain that it was −10.1 μc/g. The coarse powder with a particle diameter larger than 10.8 μm was in a quantity of 26% by weight before copying, and it increased to 44% by weight after 20,000 sheet copying.

Next, in an environment of low temperature and low humidity, a temperature of 15° C. and a humidity of 10% RH, a 20,000 sheet copying test was made. As a result, an initial image density of 1.39 decreased to 1.25.

In an environment of high temperature and high humidity, a temperature of 30° C. and a humidity of 80% RH, a 10,000 sheet copying test was also made. As a result, an initial image density of 1.35 lowered to 1.21. Restoration performance of the quantity of triboelectricity of the magnetic toner in the environment of high humidity is shown in Table 1.

Comparative Example 4

A one-component magnetic toner was obtained in the same manner as in Example 10 except that a magnetic material was used which had an average particle diameter of 0.2 μm, a saturation magnetization of 30 Am$^2$/kg and a coercive force of 140 oersted, and the amount of the magnetic material was changed to 150 parts. This one-component magnetic toner had a saturation magnetization of 18 Am$^2$/kg and a coercive force of 140 oersted.

The obtained one-component magnetic toner was used to conduct a copying test in the same manner as in Example 10.

The initial image density was 1.12, and the density after 20,000 sheet copying further decreased to 0.91. The images were not sharp with much fog. With regard to the resolution of the images, the initial one was 4.5 lines/mm, and after 20,000 sheet copying, it was further lowered to 3.2 lines/mm.

The quantity of triboelectricity of the magnetic toner was measured by blowing-off to ascertain that it was −5.4 μc/g. The coarse powder with a particle diameter larger than 10.8 μm was in a quantity of 25% by weight before copying, and it increased to 48% by weight after 20,000 sheet copying.

Restoration performance of the quantity of triboelectricity of the magnetic toner in the environment of high humidity is shown in Table 1.

Example 12

| | |
|---|---|
| Styrene/butyl methacrylate copolymer (weight average molecular weight: 250,000) | 100 parts |
| Magnetic material (average particle diameter: 0.2 μm; coercive force: 120 oersted) | 100 parts |
| Low-molecular weight polypropylene wax | 3 parts |
| Iron compound (12) | 1 part |

A black fine powder (magnetic toner) with a weight average particle diameter of 6.5 μm was obtained by using the above materials in the same manner as in Example 10.

The magnetic toner had a saturation magnetization of 32 $Am^2/kg$ and a coercive force of 120 oersted.

100 parts of the obtained magnetic toner and 1.0 part of hydrophobic silica (BET specific surface area: 200 $m^2/g$) were mixed using a Henschel mixer to obtain a one-component magnetic toner.

The one-component magnetic toner obtained was applied to a commercially available laser beam printer LBP-KT (trade name; manufactured by Canon Inc.) to make 6,000 sheet printing test.

Sharp images with an image density of 1.42 were obtained from the initial stage of printing. Even images after 6,000 sheet printing were sharp with a density of 1.45. With regard to the resolution of the images also, an initial value of 7.1 lines/mm was maintained.

The quantity of triboelectricity of the magnetic toner was measured by blowing-off to ascertain that it was −16.3 μc/g. The coarse powder with a particle diameter larger than 8.0 μm was in a quantity of 10% by weight before printing, and 12% by weight after 6,000 sheet printing so that there was little change. Restoration performance of the quantity of triboelectricity of the magnetic toner in the environment of high humidity is shown in Table 1.

Example 13

A one-component magnetic toner was obtained in the same manner as in Example 12 except that the amount of the magnetic material was changed to 150 parts. This one-component magnetic toner had a saturation magnetization of 42 $Am^2/kg$ and a coercive force of 120 oersted.

The obtained one-component magnetic toner was used to conduct a printing test in the same manner as in Example 12.

As a result, sharp images with an image density of 1.34 were obtained from the initial stage of printing. Images after 6,000 sheet printing were sharp with a density of 1.32. On the other hand, as to the resolution of the images, it was 7.1 lines/mm at the initial stage, but it lowered to 5.6 lines/mm after 6,000 sheet printing.

The quantity of triboelectricity of the magnetic toner was measured by blowing-off to ascertain that it was −12.1 μc/g. The coarse powder with a particle diameter larger than 8.0 μm was in a quantity of 12% by weight before printing, and it increased to 17% by weight after 6,000 sheet printing, between which there was a little increase.

Restoration performance of the quantity of triboelectricity of the magnetic toner in the environment of high humidity is shown in Table 1.

Example 14

| | |
|---|---|
| Styrene/butyl methacrylate copolymer (weight average molecular weight: 350,000) (peak 1: molecular weight 8,000; peak 2: molecular weight 150,000) | 100 parts |
| Magnetic material (average particle diameter: 0.2 μm; coercive force: 110 oersted) | 80 parts |
| Sasol wax | 3 parts |
| Iron compound (13) | 3 parts |

A black fine powder (negatively chargeable magnetic toner) with a weight average particle diameter of 7.5 μm was obtained by using the above materials in the same manner as in Example 10.

The magnetic toner had a saturation magnetization of 30 $Am^2/kg$ and a coercive force of 110 oersted.

100 parts of the obtained magnetic toner and 0.8 part of hydrophobic silica (BET specific surface area: 200 $m^2/g$) were mixed using a Henschel mixer to obtain a one-component magnetic toner.

The one-component magnetic toner obtained was applied to a commercially available electrophotographic copying machine NP-6060 (trade name; manufactured by Canon Inc.) to make 20,000 sheet copying test.

As a result, sharp images with an image density of 1.38 were obtained from the initial stage. Images after 20,000 sheet copying were also sharp with a density of 1.40. With regard to the resolution of the images also, an initial value of 6.3 lines/mm was maintained.

The quantity of triboelectricity of the magnetic toner was measured by blowing-off to ascertain that it was −11.2 μc/g. The coarse powder with a particle diameter larger than 10.8 μm was in a quantity of 33% by weight before printing, and 35% by weight after 20,000 sheet copying, so that there was little change. Restoration performance of the quantity of triboelectricity of the magnetic toner in the environment of high humidity is shown in Table 1.

TABLE 1

| | Tribo-elec. (1) | Triboelectricity (2) | | | | | |
|---|---|---|---|---|---|---|---|
| | | Shaken for 0 sec. | | Shaken for 60 sec. | | Shaken for 240 sec. | |
| | mC/kg | mC/kg | % | mC/kg | % | mC/kg | % |
| Example | | | | | | | |
| 1 | −11.0 | −9.9 | 90 | −11.0 | 100 | −11.0 | 100 |
| 2 | −10.2 | −9.2 | 90 | −10.0 | 98 | −10.2 | 100 |
| 3 | −10.4 | −9.4 | 90 | −10.2 | 98 | −10.4 | 98 |
| 4 | −10.3 | −8.8 | 85 | −9.6 | 93 | −9.9 | 96 |
| 5 | −9.4 | −7.8 | 83 | −9.4 | 100 | −9.4 | 100 |

TABLE 1-continued

| | Tribo-elec. (1) | Triboelectricity (2) Shaken for 0 sec. | | Shaken for 60 sec. | | Shaken for 240 sec. | |
|---|---|---|---|---|---|---|---|
| | mC/kg | mC/kg | % | mC/kg | % | mC/kg | % |
| 6 | −9.2 | −7.5 | 81 | −8.2 | 90 | −8.6 | 93 |
| 7 | −9.6 | −8.6 | 90 | −9.6 | 100 | −9.6 | 100 |
| 8 | −12.5 | −11.4 | 91 | −12.5 | 100 | −12.5 | 100 |
| 9 | −11.2 | −10.2 | 91 | −11.2 | 100 | −11.2 | 100 |
| 10 | −10.0 | −8.3 | 83 | −9.2 | 92 | −9.5 | 95 |
| 11 | −10.2 | −8.5 | 83 | −9.4 | 92 | −9.7 | 95 |
| 12 | −13.0 | −10.4 | 80 | −11.3 | 87 | −12.0 | 92 |
| 13 | −9.6 | −7.5 | 78 | −8.2 | 85 | −8.8 | 92 |
| 14 | −8.9 | −7.2 | 81 | −7.8 | 88 | −8.3 | 93 |
| Comparative Example | | | | | | | |
| 1 | −6.8 | −5.1 | 75 | −5.6 | 82 | −6.1 | 89 |
| 2 | −6.2 | −4.3 | 70 | −4.7 | 75 | −5.1 | 82 |
| 3 | −8.5 | −7.0 | 82 | −7.7 | 90 | −7.9 | 93 |
| 4 | −4.2 | −3.3 | 78 | −3.7 | 88 | −3.9 | 92 |

Triboelectricity (1): Quantity of triboelectricity of magnetic toner which was allowed to stand for 2 days at high temperature and high humidity in an uncovered polyethylene container and thereafter shaken in a tumbling mixer for 240 seconds.
Triboelectricity (2): Quantity of triboelectricity of magnetic toner which was further allowed to stand for 4 days at high temperature and high humidity and thereafter shaken in a tumbling mixer.

What is claimed is:

1. A magnetic toner for developing an electrostatic image, comprising a binder resin, a magnetic material and a compound represented by the following formula (I):

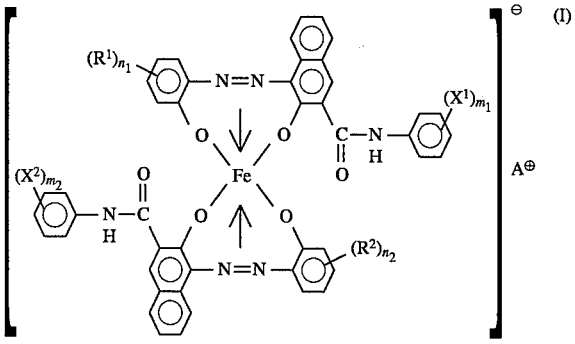

wherein $R^1$ and $R^2$ are each a member selected from the group consisting of a hydrogen atom, a sulfonic acid group, a carboxylic acid group, a carboxylate group, a hydroxyl group and a halogen atom, and may be the same or different; $n_1$ and $n_2$ are each an integer of 1 to 4; $X^1$ and $X^2$ are each a member selected from the group consisting of a hydrogen atom and a halogen atom; $m_1$ and $m_2$ are each an integer of 1 to 3; and $A^{\oplus}$ is a member selected from the group consisting of a hydrogen ion, an alkali metal ion and an ammonium ion;

said magnetic toner having a saturation magnetization of from 20 $Am^2/kg$ to 50 $Am^2/kg$ and a coercive force of from 40 oersted to 200 oersted, wherein the magnetic material is contained in an amount satisfying the following expression:

$$MT=-(10/3)\times d+(70\pm15)$$

wherein MT represents a content in % by weight of the magnetic material, and d represents a weight average particle diameter (μm) of the magnetic toner, provided that d is not more than 9 μm.

2. The magnetic toner according to claim 1, wherein the alkali metal ion is selected from the group consisting of sodium ion and potassium ion.

3. The magnetic toner according to claim 1, wherein $A^{\oplus}$ comprises an ammonium ion and an alkali metal ion.

4. The magnetic toner according to claim 3, wherein $A^{\oplus}$ has 80 to 98 mol % of ammonium ion.

5. The magnetic toner according to claim 4, wherein $A^{\oplus}$ has 85 to 95 mol % of ammonium ion.

6. The magnetic toner according to claim 1, wherein $A^{\oplus}$ comprises an ammonium ion and an hydrogen ion.

7. The magnetic toner according to claim 6, wherein $A^{\oplus}$ has 80 to 98 mol % of ammonium ion.

8. The magnetic toner according to claim 7, wherein $A^{\oplus}$ has 85 to 95 mol % of ammonium ion.

9. The magnetic toner according to claim 1, wherein $A^{\oplus}$ comprises an ammonium ion, an alkali metal ion and an hydrogen ion.

10. The magnetic toner according to claim 9, wherein $A^{\oplus}$ has 80 to 98 mol % of ammonium ion.

11. The magnetic toner according to claim 10, wherein $A^{\oplus}$ has 85 to 95 mol % of ammonium ion.

12. The magnetic toner according to claim 1, which has negative triboelectricity.

13. The magnetic toner according to claim 1, wherein the iron compound is contained in an amount of 0.1 to 10 parts by weight based on 100 parts by weight of the binder resin.

14. The magnetic toner according to claim 1, wherein the iron compound is represented by the following formula:

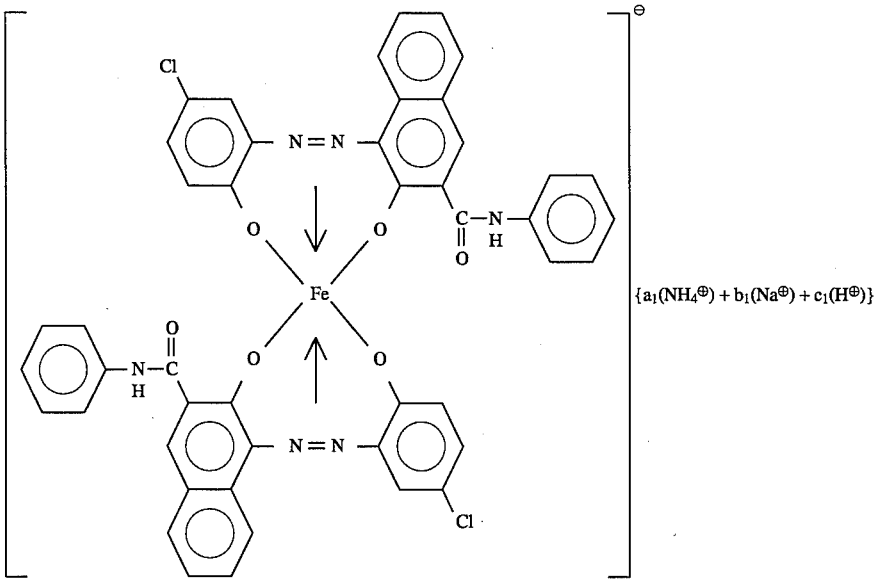
wherein $a_1+b_1+c_1$ is 1.
15. The magnetic toner according to claim 14, wherein $a_1$ is 0.8 to 0.98; $b_1$ is 0.01 to 0.19; and $c_1$ is 0.01 to 0.19.
16. The magnetic toner according to claim 15, wherein $a_1$ is 0.85 to 0.95; $b_1$ is 0.01 to 0.14; and $c_1$ is 0.01 to 0.14.
* * * * *

UNITED STATES PATENT AND TRADEMARK OFFICE

CERTIFICATE OF CORRECTION

PATENT NO. : 5,508,139

DATED : April 16, 1996

INVENTOR(S) : KATSUHIKO TANAKA, ET AL.

It is certified that error appears in the above-indentified patent and that said Letters Patent is hereby corrected as shown below:

On the title page: Item [56]

Foreign Patent Documents, "63-1994 2/1988 Japan" should read --63-1994 1/1988 Japan--.

COLUMN 2

Line 27, "but" should read --that--; and
Line 54, "sheet" should read --sheets--;

COLUMN 6

Line 47, "become" should read --becomes--.

COLUMN 25

Line 16, "result" should read --results--.

COLUMN 26

Line 3, "powder," should read --powders,--.

COLUMN 27

Line 23, "apiline," should read --aniline,--.

UNITED STATES PATENT AND TRADEMARK OFFICE

CERTIFICATE OF CORRECTION

PATENT NO. : 5,508,139

DATED : April 16, 1996

INVENTOR(S) : KATSUHIKO TANAKA, ET AL.

It is certified that error appears in the above-indentified patent and that said Letters Patent is hereby corrected as shown below:

COLUMN 36

Line 57, "Am/kg" should read --$Am^2/kg$--.

Signed and Sealed this

Fifteenth Day of October, 1996

*Attest:*

Bruce Lehman

BRUCE LEHMAN

*Attesting Officer*

*Commissioner of Patents and Trademarks*